US008505115B2

(12) United States Patent
Matsuoka

(10) Patent No.: US 8,505,115 B2
(45) Date of Patent: Aug. 13, 2013

(54) SEWN GLOVE

(75) Inventor: Koji Matsuoka, Kagawa (JP)

(73) Assignee: Matsuoka Glove Co., Ltd., Higashikagawa-Shi, Kagawa (JP)

( * ) Notice: Subject to any disclaimer, the term of this patent is extended or adjusted under 35 U.S.C. 154(b) by 338 days.

(21) Appl. No.: 12/937,978

(22) PCT Filed: Apr. 22, 2010

(86) PCT No.: PCT/JP2010/057117
§ 371 (c)(1),
(2), (4) Date: Oct. 14, 2010

(87) PCT Pub. No.: WO2011/132281
PCT Pub. Date: Oct. 27, 2011

(65) Prior Publication Data

US 2011/0258751 A1 Oct. 27, 2011

(51) Int. Cl.
*A41D 19/00* (2006.01)

(52) U.S. Cl.
USPC ..... 2/163; 2/169

(58) Field of Classification Search
USPC ..... 2/163, 169; 294/25
See application file for complete search history.

(56) References Cited

U.S. PATENT DOCUMENTS

| | | | | |
|---|---|---|---|---|
| 1,450,155 | A * | 3/1923 | Watson | 2/164 |
| 2,227,586 | A * | 1/1941 | Johnson | 2/169 |
| 3,918,096 | A * | 11/1975 | Lim | 2/161.1 |
| 4,494,249 | A * | 1/1985 | Hansson | 2/161.6 |
| 7,062,791 | B2 * | 6/2006 | Gold | 2/161.6 |
| 2008/0244808 | A1 * | 10/2008 | Chaen | 2/161.2 |

FOREIGN PATENT DOCUMENTS

| | | | |
|---|---|---|---|
| JP | 64-077609 | A | 3/1989 |
| JP | 2006-2496 | * | 6/2006 |
| JP | 3122530 | U | 6/2006 |
| JP | 2009-030216 | | 2/2009 |
| WO | 2009/001582 | A1 | 12/2008 |

OTHER PUBLICATIONS

Japanese Office Action issued Jul. 30, 2012 in corresponding Japanese application No. 2010-539952.
English Abstract for WO 2009/001582 A1, published Dec. 31, 2008.
English Abstract for 64-077609 A, published Mar. 23, 1989.

* cited by examiner

*Primary Examiner* — Katherine Moran
(74) *Attorney, Agent, or Firm* — NDQ&M Watchstone LLP

(57) ABSTRACT

A sewn glove is provided which can be put on a hand and used without providing an uncomfortable feeling and in which fingers can be greatly (deeply) bent. The sewn glove includes a finger pocket formed by sewing a finger-back member for covering a back surface of a finger and a finger-palm member having a width wide enough to cover a palm surface and right and left sides of the finger. The finger pocket is bent toward a palm side. A finger-palm member (12) is divided into divided finger-palm members (12X, 12Y, 12Z) at positions corresponding to interphalangeal joints of the finger. Each divided portion edge of each of the divided finger-palm members (12X, 12Y, 12Z) is a cut edge (15*a*, 15*b*) extending to cover from the left side of the finger through the palm surface of the finger to the right side of the finger. In the cut edge (15*a*, 15*b*), inclined straight edges (15*a*1, 15*a*3, 15*b*1, 15*b*3) extend continuously from the right and left ends of a finger-palm straight edge (15*a*2, 15*b*2) for an interphalangeal joint of the finger. The divided finger-palm members (12X, 12Y, 12Z) are sewn together along the cut edges (15*a*, 15*b*) to bend the entire finger pocket including the finger-back member toward the palm side.

5 Claims, 20 Drawing Sheets

(a)

(b)

(a)

(b)

(c)

SEWN GLOVE

CROSS REFRENCE TO RELATED APPLICATIONS

This application is a national stage application of International Application No. PCT/JP2010/57117, filed Apr. 22, 2010. The content of the above-identified application is hereby incorporated by reference in its entirety.

TECHNICAL FIELD

This invention relates to a sewn glove sewn such that finger pockets are bent toward the palm side in advance.

BACKGROUND ART

In a comparatively thick glove for skiing, motorcycling, or the like, for example, if finger pockets 204 are bent toward the palm side (finger palm side) in advance as shown in FIG. 21, only small bending forces of fingers are needed to grasp a ski pole, a motorcycle handgrip, or the like, thereby providing an easy grip. Here, the finger pockets 204 bent toward the palm side in advance are usually for four fingers from a little finger to an index finger, but there are gloves in which even a thumb pocket is bent toward the palm side.

In the sewn glove shown in FIG. 21, for the sake of bending the finger pockets (four finger pockets for a little finger to an index finger) 204 toward the palm side in advance, each finger pocket 204 is bent toward the palm side using gore materials 205 and 205 for covering the right and left sides of a finger as shown in FIGS. 22 and 23.

Specifically, each of the finger pockets (except the thumb pocket) 204 is sewn into the shape of a pocket as shown in FIG. 23 by using a finger-palm member 212, a finger-back member 222, and a pair of right and left gore materials 205 as shown in FIG. 22 and by sewing edges, in the width direction, of the members 212, 222, and 205 together. Here, each of the finger pockets (except the thumb pocket) 204 is bent toward the palm side as in FIG. 21 by using the gore materials 205 and 205 cut into a curved shape (e.g., see Patent Document 1).

In the sewn glove shown in FIG. 21, each of the finger pockets 204 for a little finger to an index finger is bent toward the palm side in advance. In the case where the gore materials 205 and 205 are used, sewn portions (seam lines) L and L are formed over the entire length of the finger pocket 204. In the sewn portions, the right and left edges of the finger-palm member 212 and respective one edges of the gore materials 205 and 205 are sewn together as shown in FIG. 23. These sewn portions L and L are formed by sewing the edges of the members 212 and 205 with a thread with the edges of the members 212 and 205 facing inward. Accordingly, bending resistance is large, and ridges are formed on both sides of the finger-palm member 212 in the finger pocket 204, respectively.

As described above, in the sewn glove shown in FIGS. 21 to 23, the finger pocket 204 can be bent toward the palm side in advance using the gore materials 205 and 205. However, the sewn portions L and L are formed on both sides of the finger-palm member 212. For this reason, when an item (grip) is grasped with a hand wearing this sewn glove, the presence of the sewn portions L and L on both sides of the finger-palm member 212 between the fingers and the item (grip) provides an uncomfortable feeling, and the sewn portions L and L serve as bending resistance and make each finger pocket 204 difficult to bend.

As described above, the use of the gore materials 205 limits the maximum degree to which the finger pocket 204 can be bent. However, if a soft and thin material is used for the gore materials 205 so that the finger pocket 204 can be greatly bent, the gore materials 205 are so soft and thin that the gore materials 205 can be stretched, contorted, and twisted, and cannot maintain an intended three-dimensional shape.

To cope with this, the structure of a finger-palm member 312 has been proposed in which substantially elliptic holes 315 are punched out with a part (approximately 0.5 mm to 1 mm) left uncut on each of the right and left edges, at positions corresponding to the two interphalangeal joints (the first interphalangeal joint (interphalangeal joint on the fingertip side) and the second interphalangeal joint (interphalangeal joint on the finger base side)) of a finger as shown in FIG. 24(*a*).

Specifically, FIG. 24(*a*) shows a state in which the finger-palm member 312 is expanded, and this finger-palm member 312 includes a finger-palm surface covering portion 313 and further includes, on the right and left sides thereof, finger-side covering portions 314 and 314 cut integrally with the finger-palm surface covering portion 313. From the expanded state, as shown in FIG. 24(*b*), the finger-palm member 312 is bent in the width direction into a U-shape, and concave-arc-shaped edges 315*a* and 315*b*, which face each other, of each of the substantially elliptic holes 315 and 315 are sewn together along the concave-arc-shaped edges 315*a* and 315*b*. Here, tip end portions of the concave-arc-shaped edges 315*a* and 315*b* are sewn together with the concave-arc-shaped edges 315*a* and 315*b* folded inside the finger pocket. Sewing the concave-arc-shaped edges 315*a* and 315*b* of the substantially elliptic hole 315 together as described above causes portions around the substantially elliptic hole 315 to get together. Thus, the finger-palm member 312 is bent toward the palm side (finger palm side) at sewn portions M and M of the concave-arc-shaped edges 315*a* and 315*b*.

Further, from the state shown in FIG. 24(*b*), as shown in FIG. 24(*c*), the finger-palm member 312 and the finger-back member 322 can be sewn into the shape of the finger pocket 304 by sewing the right and left edges of the finger-palm member 312 and the right and left edges of the finger-back member 322 together, respectively (sewn portions N and N). Note that the sewn portions M and N are sewn from the backsides of the materials. Moreover, other parts of the palm and hand-back members and the thumb pocket member are sewn normally in a conventional manner.

Thus, a glove such as shown in FIG. 21 is sewn (e.g., see Patent Documents 1 and 2).

In a sewn glove having this finger pocket 304 shown in FIG. 24, no sewn portions are formed on both sides of the finger-palm member 312.

Accordingly, when an item (grip) is grasped with a hand wearing this sewn glove, there is no sewn portion between the fingers and the item, and the bending resistance of the finger pocket 304 is small. Thus, each finger pocket 304 is easy to bend. Moreover, the sewn portions M are buried in portions of the interphalangeal joints of the bent finger and therefore become less annoying.

In the case of the finger pocket 304 shown in FIG. 24, in consideration of workability, each of the parts right and left of each substantially elliptic hole 15 may be cut to divide the finger-palm member 312 into three portions, which are sewn together. Also, a French seam, an overlapping pique seam, or the like may be employed.

PRIOR ART DOCUMENTS

Patent Documents

Patent Document 1: Japanese Utility Model Registration No. 3122530.

Patent Document 2: Japanese Patent Application Laid-Open No. 2009-30216.

DISCLOSURE OF THE INVENTION

Technical Problem

In the sewn glove shown in FIG. 24, the bending resistance of each finger pocket 304 is small, and each finger pocket 304 can be easily bent. However, there is a demand to bend the finger pocket 304 more greatly (deeply) toward the palm side in advance so that the fingers can be easily bent more greatly. One way to respond to this demand is to make the depth of the substantially elliptic hole 315 in FIG. 24 larger (deeper).

In the case where the depth of the substantially elliptic hole 315 in FIG. 24 is made larger (deeper), the finger pocket 304 can be greatly bent toward the palm side in advance. However, the sewn portions M and M formed by sewing the concave-arc-shaped edges 315*a* and 315*b* of each substantially elliptic hole 315 together do not lie along the interphalangeal joints of a finger, and thus form large gaps between the interphalangeal joints of the finger and the sewn portions M and M. In addition, the finger pocket 304 becomes contorted and twisted because of the difficulty of sewing with a sewing machine. If the sewn portions M and M do not lie along the interphalangeal joints of the finger or the finger pocket 304 becomes contorted and twisted as described above, the sewn portions M and M touch right and left portions of the interphalangeal joints of a finger in the process of putting the sewn glove on, so that the sewn glove is difficult to put on. Moreover, during usage (grasping), an uncomfortable feeling is experienced since the sewn portions M and M do not lie along the interphalangeal joints of the finger.

This invention has been made to solve the above-described problems, and is intended to provide a sewn glove which can be put on a hand and used without an uncomfortable feeling and in which fingers can be greatly (deeply) bent.

Technical Solution

The present invention is a sewn glove including a finger pocket formed by sewing a finger-back member for covering a back surface of a finger and a finger-palm member having a width wide enough to cover a palm surface and right and left sides of the finger, the finger pocket being bent toward a palm side.

The finger-palm member is divided into a plurality of, three, for example, divided finger-palm members at a position corresponding to each interphalangeal joint of the finger.

A divided portion edge of each of the divided finger-palm members is a cut edge extending from a left side covering portion corresponding to the left side of the finger through a palm surface covering portion corresponding to the palm surface of the finger to a right side covering portion corresponding to the right side of the finger, the cut edge formed into such a recessed shape that inclined straight edges extend continuously from right and left ends of a straight edge of the palm surface covering portion parallel to the interphalangeal joint of the finger.

The divided finger-palm members are sewn together along the cut edges to bend the entire finger pocket including the finger-back member toward the palm side.

The present invention is also a sewn glove including a finger pocket faulted by sewing a finger-back member for covering a back surface of a finger and a finger-palm member having a width wide enough to cover a palm surface and right and left sides of the finger, the finger pocket being bent toward a palm side.

The finger-palm member is provided with a hole at a position corresponding to each interphalangeal joint of the finger with a part left uncut on each of right and left edges of the finger-palm member, the hole having a shape formed by placing curves such that the curves face each other, each of the curves extending from a left side covering portion corresponding to the left side of the finger through a palm surface covering portion corresponding to the palm surface of the finger to a right side covering portion corresponding to the right side of the finger, each of the curves being formed such that inclined straight portions extend continuously from right and left ends of a straight portion of the palm surface covering portion parallel to the interphalangeal joint of the finger.

Opposing edges across the hole which face each other are sewn together along the opposing edges to bend the entire finger pocket including the finger-back member toward the palm side.

Advantageous Effects

According to this invention, the entire finger pocket including the finger-back member is bent toward the palm side by sewing the divided finger-palm members together along the cut edges. Alternatively, the entire finger pocket including the finger-back member is bent toward the palm side by sewing the opposing edges across the hole, which face each other, together along the opposing edges. Accordingly, a space of a portion of the finger pocket which corresponds to each of the interphalangeal joints of the finger is steeply raised by the right and left inclined straight edges or edges of the inclined straight portions, and a sufficient spatial expanse (length) in a direction perpendicular to the insertion direction of the finger can be ensured by the straight edge or an edge of the straight portion. Accordingly, the sewn portion does not touch right and left portions of the interphalangeal joint of the finger, and the sewn glove can be put on a hand without an uncomfortable feeling. Also, during usage, since the sewn portion lies along the interphalangeal joint of the finger to reduce the gap between the interphalangeal joint of the finger and the sewn portion and is buried in a portion of the interphalangeal joint of the bent finger, the finger can be greatly (deeply) bent without an uncomfortable feeling.

BEST MODES FOR CARRYING OUT THE INVENTION

Hereinafter, embodiments of this invention will be described with reference to the drawings.

Figure 1:
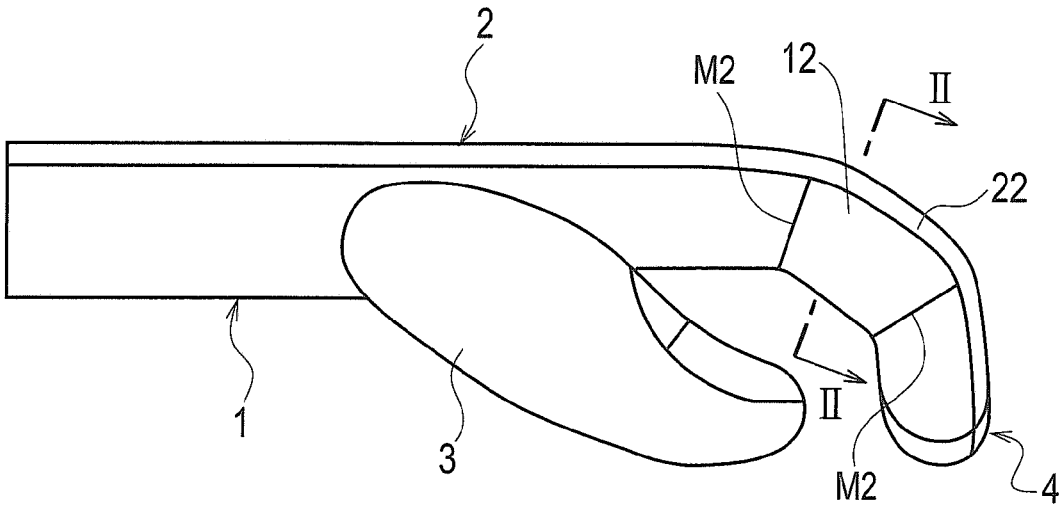
FIG. 1 is a side view of a sewn glove of a first embodiment of this invention as viewed from a thumb pocket side.

As shown in FIG. 1, a sewn glove of a first embodiment of this invention is sewn using a palm member 1, a hand-back member 2, and a thumb pocket member 3. In other words, the sewn glove of the first embodiment is sewn as shown in FIG. 1 using the palm member 1, the hand-back member 2, and the thumb pocket member 3 shown in FIGS. 5 and 6.

As these materials (for palm member 1, hand-back member 2, and thumb pocket member 3), leather or synthetic leather is mainly used.

Note that the sewn glove of this invention is suitable as a comparatively thick glove mainly used for skiing, motorcycling, or the like and used to grasp a grip, but can also be applied to a comparatively thin glove for golf, batting, or the like.

Figure 5:
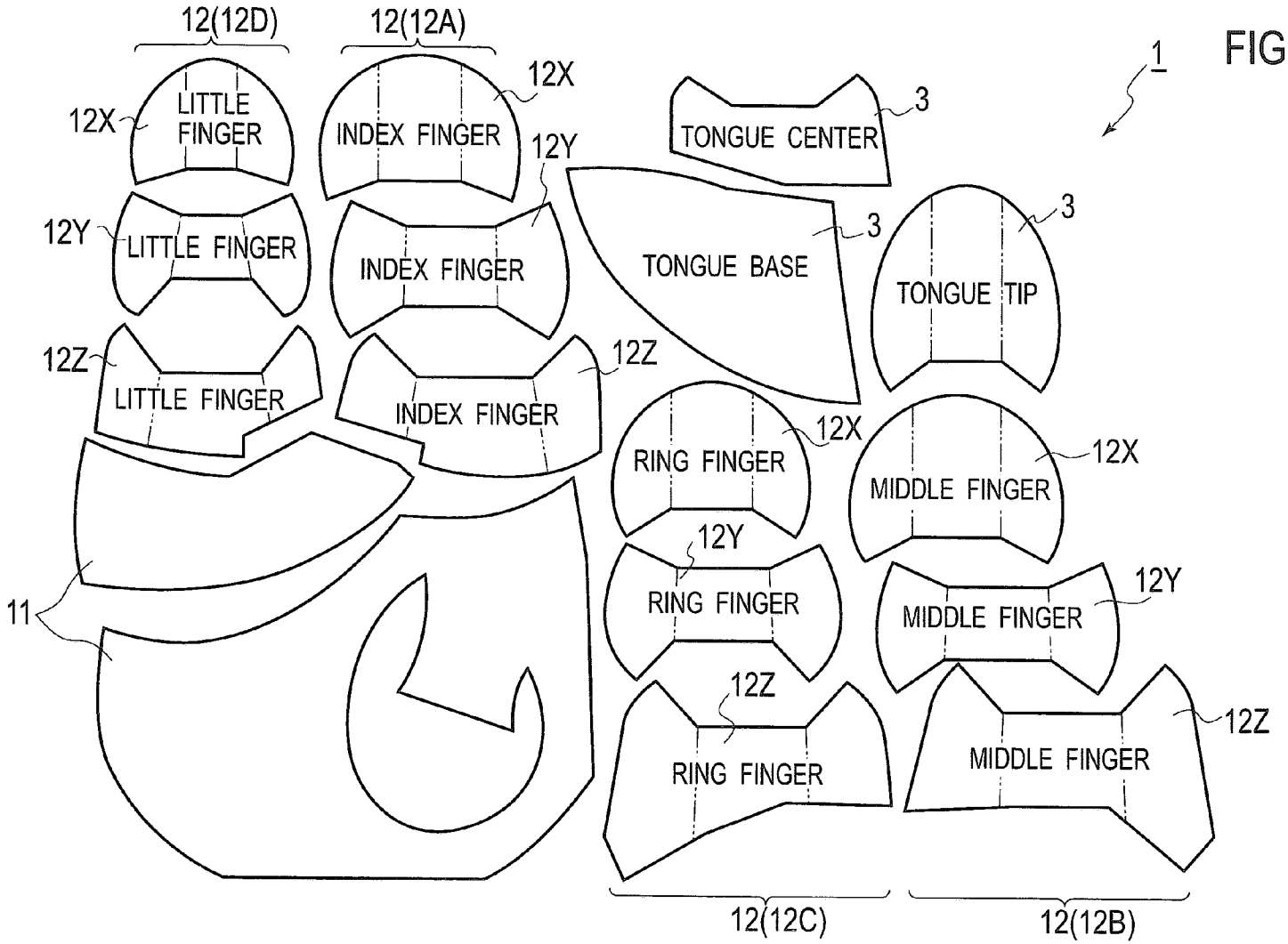
FIG. 5 is a plan view of a palm member and a thumb pocket member used in the sewn glove of the first embodiment of this invention.
Figure 6:
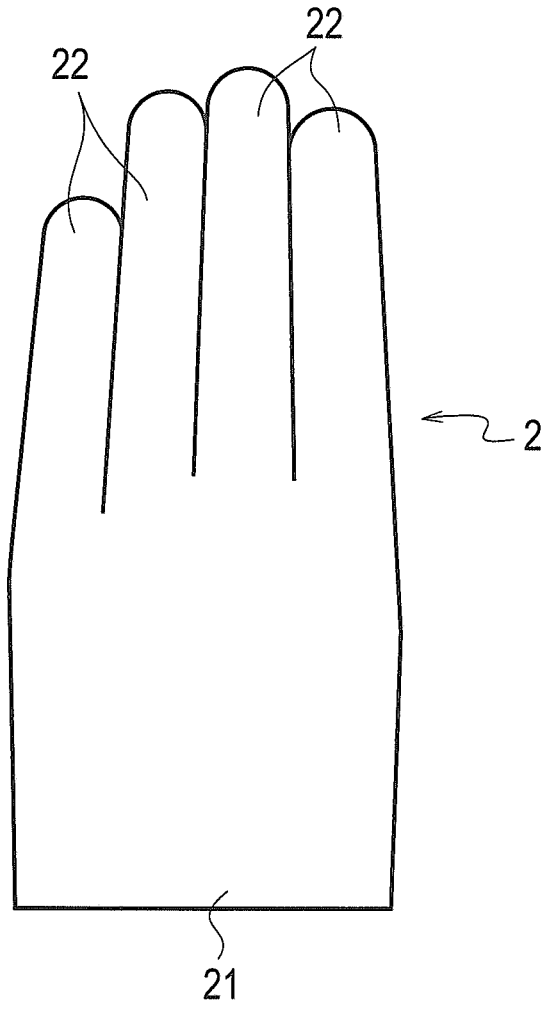
FIG. 6 is a plan view of a hand-back member used in the sewn glove of the first embodiment of this invention.

FIGS. 5 and 6 are plan views of the palm member 1, the hand-back member 2, and the thumb pocket member 3 in cut states. The palm member 1 includes a palm portion 11, a finger-palm member 12 (12A) for an index finger, a finger-palm member 12 (12B) for a middle finger, a finger-palm member 12 (12C) for a ring finger, and a finger-palm member 12 (12D) for a little finger, which are cut separately. Moreover, the hand-back member 2 includes a palm portion 21 and four finger-back members 22 for fingers from a little finger to an index finger cut integrally with the palm portion 21.

Figure 7:
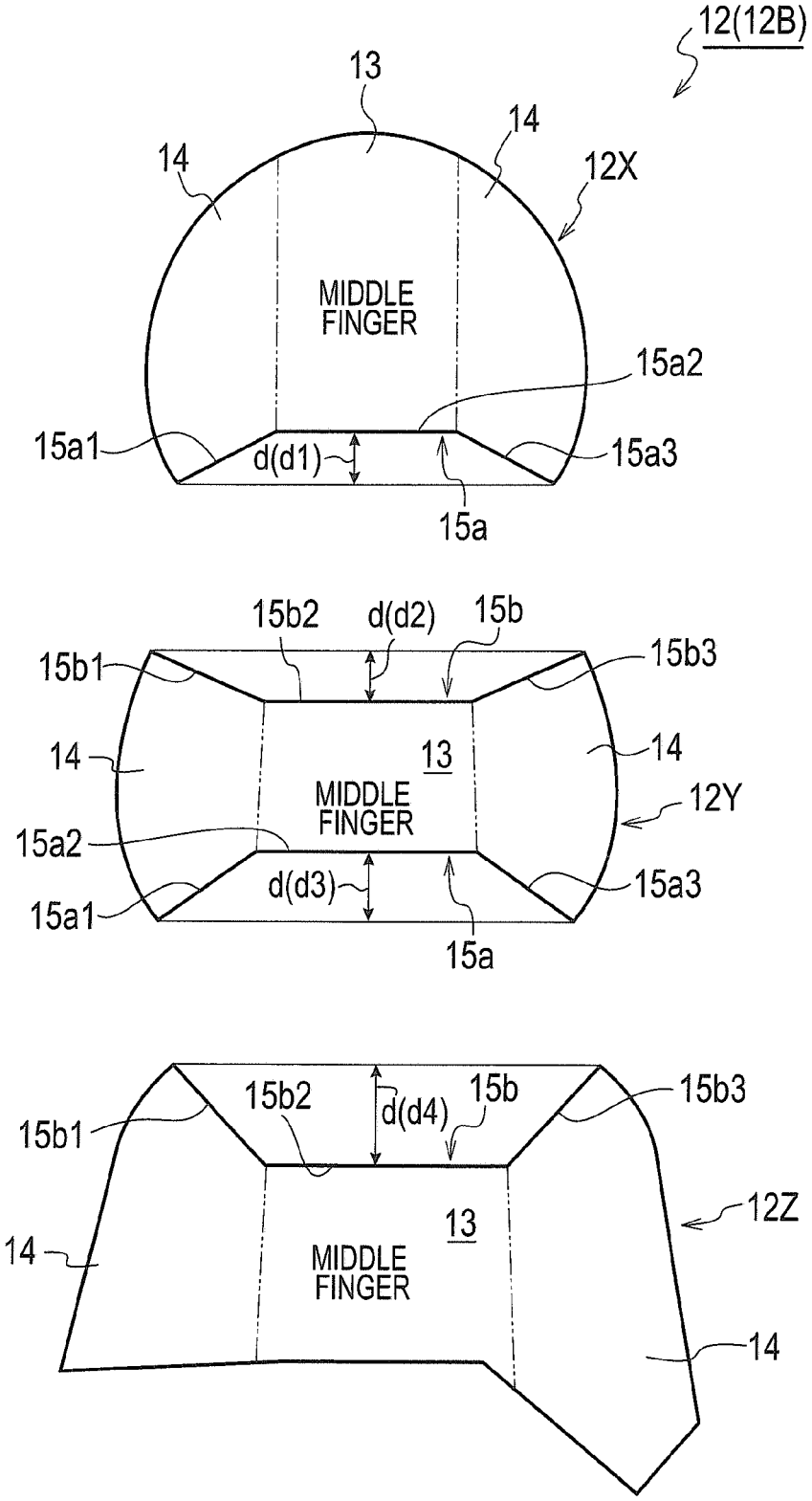
FIG. 7 is an explanatory diagram showing a configuration of cut edges in the sewn glove of the first embodiment of this invention.

Each of the four finger-palm members 12 has a width wide enough to cover the palm surface and right and left sides of a finger as in the finger-palm member 12 (12B) for a middle finger shown in FIG. 7. In other words, each of the finger-palm members 12 is cut in such a width that a palm surface covering portion 13 corresponding to the palm surface of a finger has, on the right and left sides thereof, side covering portions 14 and 14 respectively corresponding to the right and left sides of the finger. Further, as shown in FIGS. 5 and 7, each of the four finger-palm members 12 is divided at positions corresponding to the interphalangeal joints (first and second interphalangeal joints) of a finger into three divided finger-palm members 12X, 12Y, and 12Z for the distal phalanx (portion from the first interphalangeal joint to the fingertip), the middle phalanx (portion between the first and second interphalangeal joints), the proximal phalanx (portion from the second interphalangeal joint to the palm side).

Further, each edge of divided portions of each of the divided finger-palm members 12X, 12Y, and 12Z is a recessed cut edge 15*a* (15*b*). The recessed cut edge 15*a* (15*b*) is formed by a straight edge 15*a*2 (15*b*2) of the palm surface covering portion 13, which is parallel to the interphalangeal joints of the finger, and inclined straight edges 15*a*1 and 15*a*3 (15*b*1 and 15*b*3) continuous with the right and left ends of the straight edge 15*a*2 (15*b*2), and extends from the left side covering portion 14 corresponding to the left side of a finger through the palm surface covering portion 13 corresponding to the palm surface of the finger to the right side covering portion 14 corresponding to the right side of the finger. The inclined straight edges 15*a*1 and 15*b*1 face each other, the straight edges 15*a*2 and 15*b*2 face each other, and the inclined straight edges 15*a*3 and 15*b*3 face each other. In other words, each of the cut edges 15*a* and 15*b* fauns the shape of an isosceles trapezoid (with its base open) using three straight lines.

Note that the way to assign reference numerals to the palm surface covering portion 13, the side covering portion 14, the cut edges 15*a* and 15*b*, the inclined straight edges 15*a*1, 15*a*3, 15*b*1, and 15*b*3, and the straight edges 15*a*2 and 15*b*2 of the finger-palm members 12 in FIG. 5 is the same as that in FIG. 7, and therefore the reference numerals are omitted.

Figure 10:
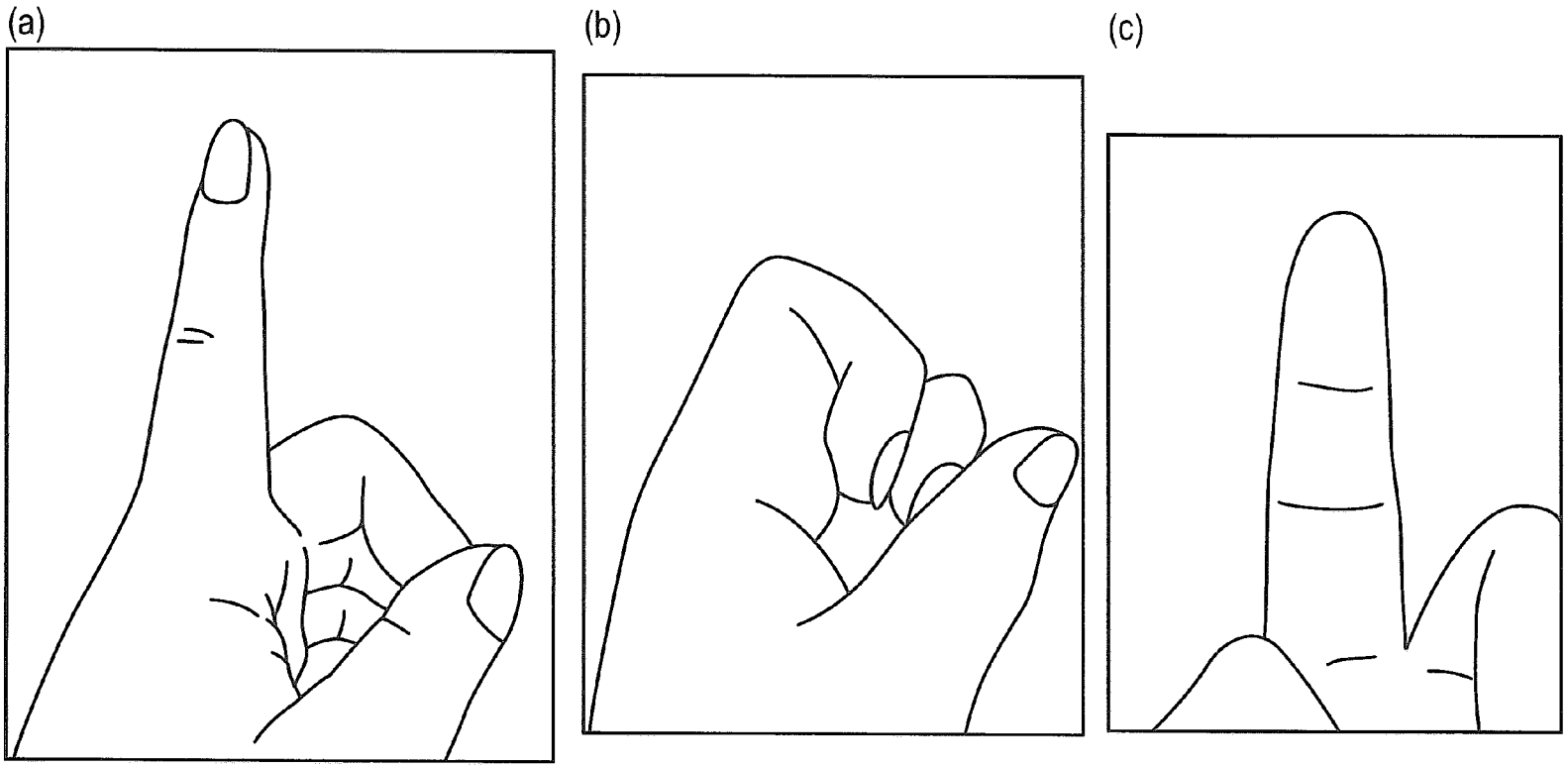
FIG. 10 is an explanatory diagram showing the process of bending a finger and states of bending of the finger.

Further, with regard to the depths (heights) d of the cut edges 15*a* and 15*b* corresponding to the interphalangeal joint portions, the sum (d3+d4) (see FIG. 7) of the depths d of the cut edges 15*a* and 15*b* (second interphalangeal joint portion) on the finger base side is larger than the sum (d1+d2) (see FIG. 7) of the depths d of the cut edges 15*a* and 15*b* (first interphalangeal joint portion) on the fingertip side. This is because the first interphalangeal joint portion can be bent to an angle slightly larger than 90 degrees, and the second interphalangeal joint portion can be bent beyond 90 degrees to approximately 120 degrees. This can be understood by, as shown in FIG. 10, bending (FIG. 10(*b*)) an index finger from a stretched state (FIG. 10(*a*)) and then stretching (FIG. 10(*c*)) the index finger again.

Moreover, with regard to the depths (heights) d of the cut edges 15*a* and 15*b* which face each other, in the case of a pique seam, the depth d of the cut edge of the divided finger-palm member to be located on the upper side when overlapped is larger because the length of the cut edge of the divided finger-palm member which is located on the upper side (surface side) is to be longer than the length of the cut edge of the divided finger-palm member which is located on the lower side (backside). Specifically, for example, as shown in FIG. 7, the depth d1 of the cut edge 15*a* of the divided finger-palm member 12X is smaller than the depth d2 of the cut edge 15*b* of the divided finger-palm member 12Y. Moreover, the depth d3 of the cut edge 15*a* of the divided finger-palm member 12Y is smaller than the depth d4 of the cut edge 15*b* of the divided finger-palm member 12Z.

On the other hand, in the case of inseam sewing, the depths d of the cut edges 15*a* and 15*b* which face each other are the same.

Note that movements of fingers differ depending on the kind of sports such as golf, skiing, motorcycling, or cycling. Curves along movements of fingers in an intended sport can be given to the finger pockets 4 using the cut edges 15*a* and 15*b*. This is enabled by the fact that finger portions are independent of a main body.

Figure 8:
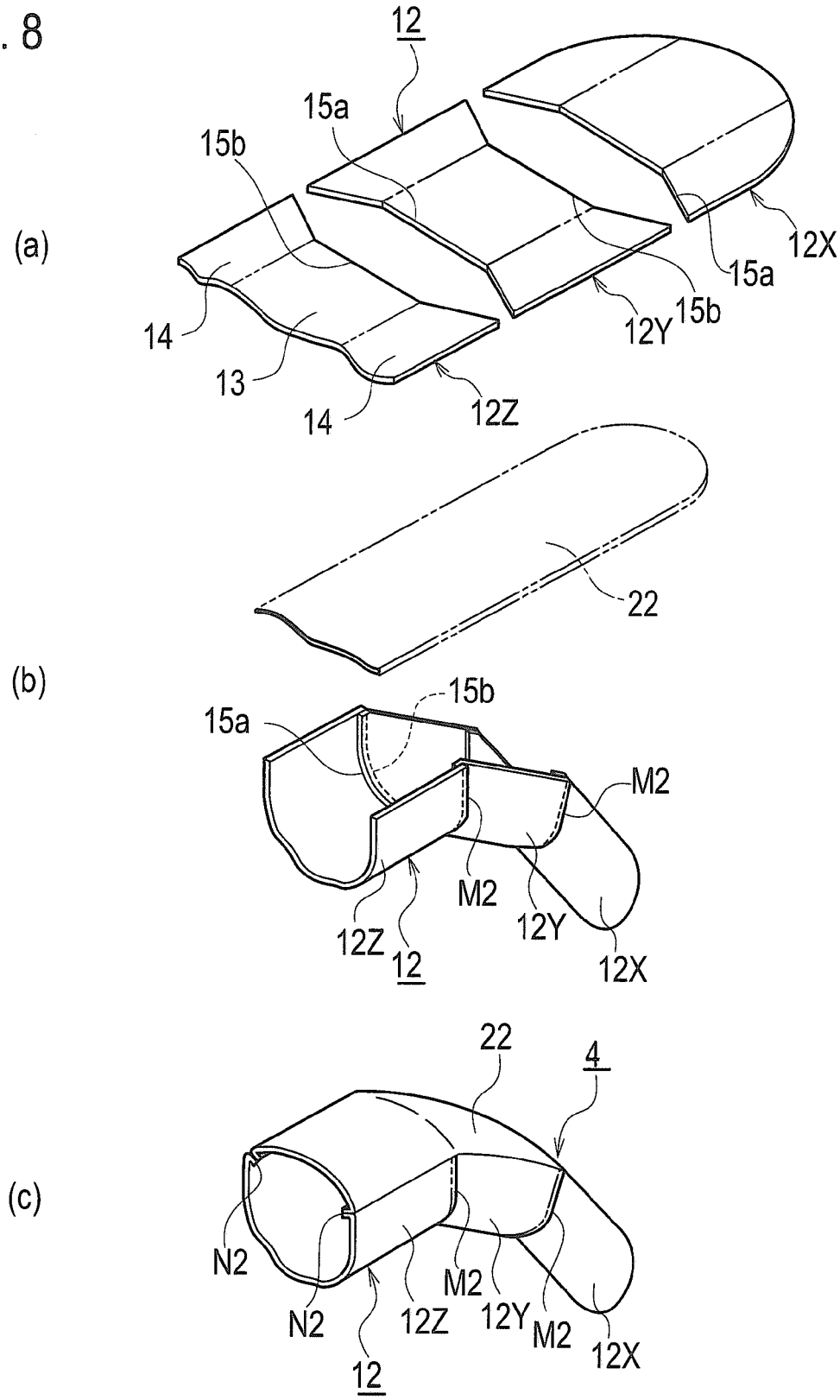
FIG. 8 is an explanatory diagram showing a method of sewing a finger pocket portion in the sewn glove of the first embodiment of this invention.

In this sewn glove of the first embodiment, the finger pocket 4 is sewn as shown in FIGS. 8(*a*) to (*c*).

Figure 9:
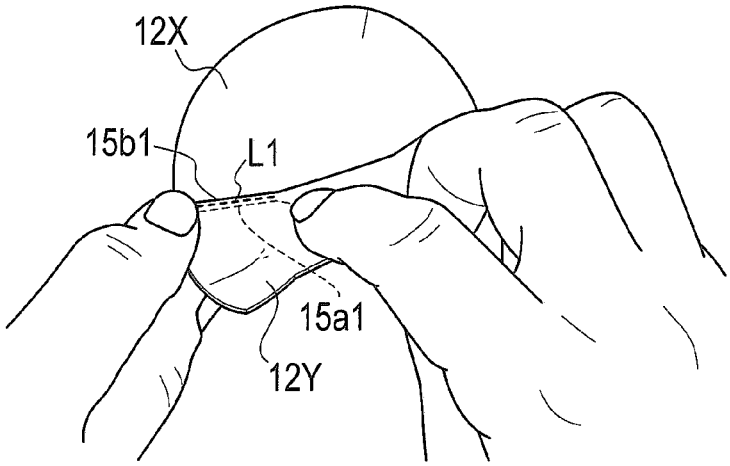
FIG. 9 is an explanatory diagram showing a method of sewing divided finger-palm members in the sewn glove of the first embodiment of this invention.
Figure 9:
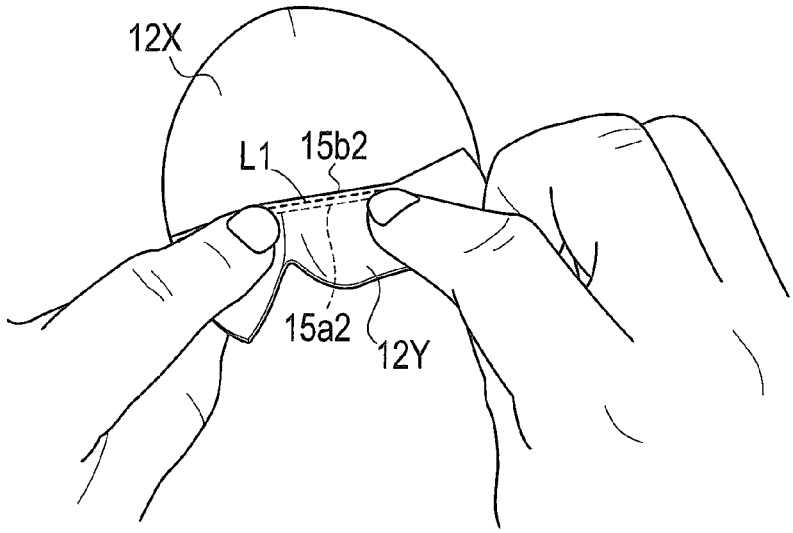
Figure 9:
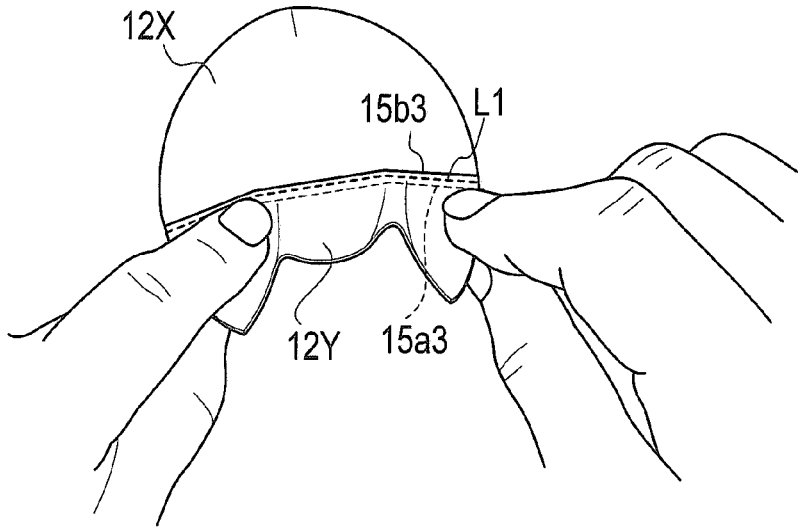

First, for the two divided finger-palm members 12X and 12Y in the expanded states shown in FIG. 8(*a*), as shown in FIG. 9(*a*), the cut edge 15*b* (inclined straight edge 15*b*1) of the left side covering portion 14 of the divided finger-palm member 12Y for a middle phalanx is overlapped on the cut edge 15*a* (inclined straight edge 15*a*1) of the left side covering portion 14 of the divided finger-palm member 12X for a distal phalanx, and the cut edges 15*a* and 15*b* are sewn together along the inclined straight edges 15*a*1 and 15*b*1 in the foam of, for example, a straight line.

Next, as shown in FIG. 9(*b*), the cut edge 15*b* (straight edge 15*b*2) of the palm surface covering portion 13 of the divided finger-palm member 12Y for a middle phalanx is overlapped on the cut edge 15*a* (straight edge 15*a*2) of the palm surface covering portion 13 of the divided finger-palm member 12X for a distal phalanx, and the cut edges 15*a* and 15*b* are sewn together along the straight edges 15*a*2 and 15*b*2 in the form of a straight line.

Figure 3:
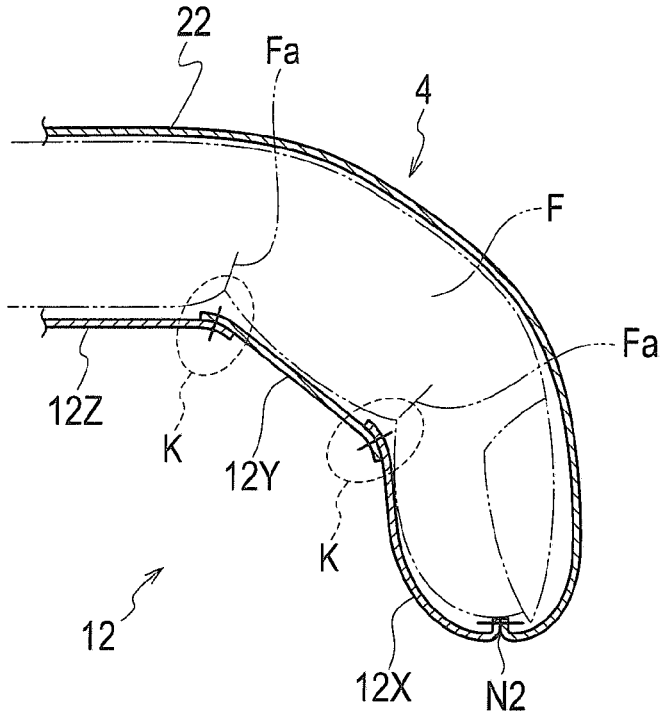
FIG. 3 is cross-sectional views of a finger pocket of FIG. 1 along the longitudinal direction.
Figure 3:
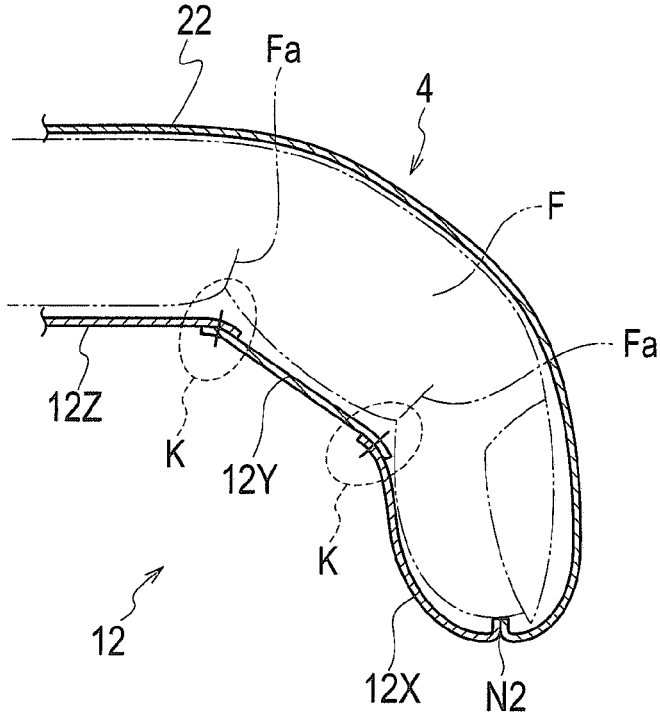

Further, as shown in FIG. 9(*c*), the cut edge 15*b* (inclined straight edge 15*b*3) of the right side covering portion 14 of the divided finger-palm member 12Y for a middle phalanx is overlapped on the cut edge 15*a* (inclined straight edge 15*a*3) of the right side covering portion 14 of the divided finger-palm member 12X for a distal phalanx, and the cut edges 15*a* and 15*b* are sewn together along the inclined straight edges 15*a*3 and 15*b*3 in the form of a straight line (pique seam; see FIG. 3(*a*)). Note that broken lines L1 in FIGS. 9(*a*) to (*c*) indicate sewing threads.

Similarly, the cut edge 15*b* (inclined straight edge 15*b*1) of the left side covering portion 14 of the divided finger-palm member 12Z for a proximal phalanx is overlapped on the cut edge 15*a* (inclined straight edge 15*a*1) of the left side covering portion 14 of the divided finger-palm member 12Y for a middle phalanx, and the cut edges 15*a* and 15*b* are sewn together along the inclined straight edges 15*a*1 and 15*b*1.

Next, the cut edge 15*b* (straight edge 15*b*2) of the palm surface covering portion 13 of the divided finger-palm member 12Z for a proximal phalanx is overlapped on the cut edge 15*a* (straight edge 15*a*2) of the palm surface covering portion 13 of the divided finger-palm member 12Y for a middle phalanx, and the cut edges 15*a* and 15*b* are sewn together along the straight edges 15*a*2 and 15*b*2.

Further, the cut edge 15*b* (inclined straight edge 15*b*3) of the right side covering portion 14 of the divided finger-palm member 12Z for a proximal phalanx is overlapped on the cut edge 15*a* (inclined straight edge 15*a*3) of the right side covering portion 14 of the divided finger-palm member 12Y for a middle phalanx, and the cut edges 15*a* and 15*b* are sewn together along the inclined straight edges 15*a*3 and 15*b*3 (pique seam).

Sewing the divided finger-palm members 12X, 12Y, and 12Z together as described above causes the recessed cut portions to be drawn toward each other. Thus, the finger-palm member 12 is bent toward the palm side (finger palm side) at sewn portions M2 and M2 as shown in FIG. 8(*b*).

Further, from the state shown in FIG. 8(*b*), as shown in FIG. 8(*c*), the finger-palm member 12 and the finger-back member 22 can be sewn into the shape of the finger pocket 4 by sewing the right and left edges of the finger-palm member 12 and the right and left edges of the finger-back member 22 together, respectively (sewn portions N2 and N2). Note that at each of the sewn portions N2, the materials are sewn from their backsides (inseam sewing). Moreover, other parts of the palm member and the hand-back member and the thumb pocket member are sewn normally in a conventional manner. Thus, a sewn glove is made.

Figure 2:
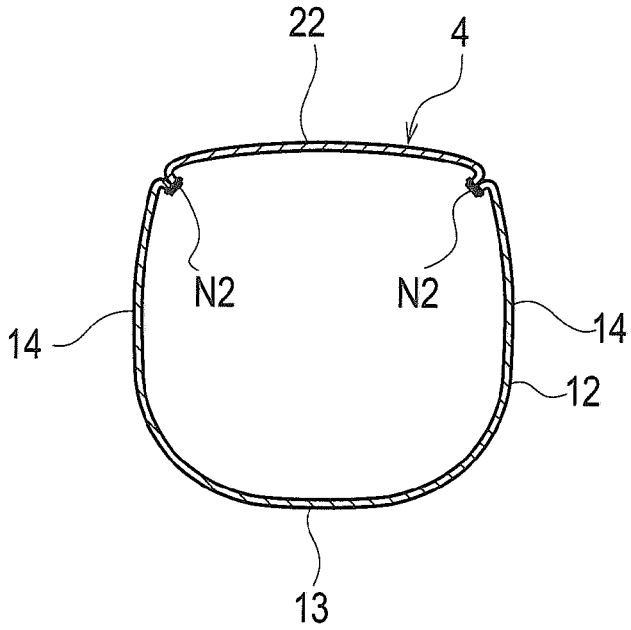
FIG. 2 is an enlarged cross-sectional view taken along line II-II of FIG. 1.

In a sewn glove having this finger pocket 4 shown in FIG. 8, as shown in FIG. 2, sewn portions are not formed on both sides of the finger-palm member 12. Accordingly, when an item (grip) is grasped with a hand wearing this sewn glove, there is no sewn portion between a finger F and the item, and the bending resistance of the finger pocket 4 becomes small. Thus, each finger pocket 4 is easy to bend, and only a small bending force is needed.

Moreover, a space of the finger pocket 4 at a portion corresponding to each interphalangeal joint Fa of a finger F is steeply raised by the right and left inclined straight edges 15*a*1, 15*a*3, 15*b*1, and 15*b*3, and a sufficient spatial expanse (length) in a direction perpendicular to the insertion direction of the finger F can be ensured by the straight edges 15*a*2 and 15*b*2. Accordingly, the sewn portion M2 does not touch right and left portions of the interphalangeal joint Fa of the finger F, and thus the sewn glove can be put on a hand without providing an uncomfortable feeling. Also, during usage, since the sewn portion M2 lies along the interphalangeal joint Fa of the finger F to reduce the gap between the interphalangeal joint Fa and the sewn portion M2 and is buried in a portion corresponding to the interphalangeal joint Fa of the bent finger F, the finger F can be greatly (deeply) bent without an uncomfortable feeling.

Figure 24:
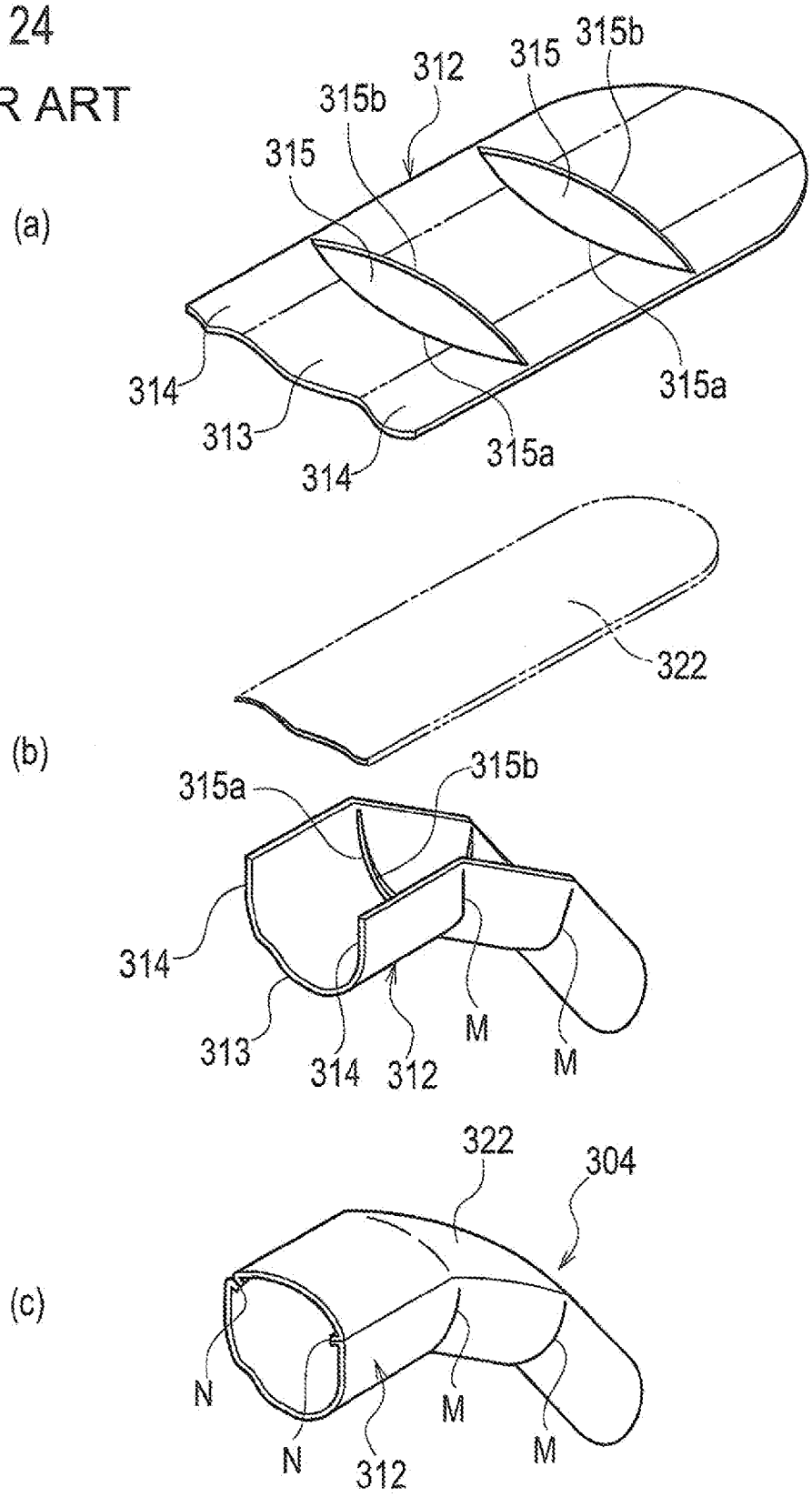
FIG. 24 PRIOR ART
FIG. 24 is an explanatory diagram showing a method of sewing a finger pocket portion of another example of a conventional sewn glove.

In the case of manufacturing a sewn glove (sewn glove having a finger pocket bent toward the palm side in an ordinary state, i.e., in a state in which no external force is applied) in which a finger pocket is bent in advance toward the palm side using concave portions in the shape of the arc of an ellipse such as shown in FIG. 24, to increase the degree of bending requires increasing the depths of the concave portions in the shape of the arc of an ellipse.

When a sewn glove is formed by increasing the depths of the concave portions in the shape of the arc of an ellipse and sewing the concave portions of each finger-palm member, and this sewn glove is put on a hand, large gaps are left between the interphalangeal joint portions of fingers and the concave portions. Accordingly, a wearer may feel an uncomfortable feeling. Moreover, in some cases, when finger pockets bent in advance are to be stretched in the shape of a straight line, the finger pockets do not sufficiently stretch.

On the other hand, in the sewn glove of this invention, as shown in FIG. 7 and the like, the recessed portions of each finger-palm member are formed in the shape of an isosceles trapezoid, and a sewn glove is formed by sewing the recessed portions in the shape of an isosceles trapezoid of each finger-palm member together. Thus, portions corresponding to the upper bases of the recessed portions in the shape of an isosceles trapezoid of each finger-palm member which are sewn together are in the shape of a straight line. Further, when a finger is bent, the interphalangeal joint portions on the finger palm are approximately in the shape of a straight line.

Moreover, when a wearer puts on the sewn glove of this invention, the upper bases of the isosceles trapezoids face the interphalangeal joint portions on the finger palm, and the legs of the isosceles trapezoids face the interphalangeal joint portions on the sides of the finger.

As described above, the portions corresponding to the upper bases sewn together and the interphalangeal joint portions on the finger palm when the finger is bent have such forms that the distances therebetween are smaller than in the cases of conventional sewn gloves. This can prevent large gaps from being left between the interphalangeal joint portions of the finger and the sewn portions of the recessed portions when a wearer puts on the sewn glove of this invention, and can avoid causing a wearer to feel an uncomfortable feeling. Moreover, when the finger pocket bent in advance is to be stretched in the shape of a straight line, the finger pocket can be sufficiently stretched.

Moreover, since each of the cut edges 15*a* and 15*b* is formed by three straight lines, and each of the cut edges 15*a* and 15*b* is in the shape of a isosceles trapezoid, edges of the divided finger-palm members 12X, 12Y, and 12Z can be overlapped using the corners of the cut edges 15*a* and 15*b* as signs. Also, since the sewn portions of the cut edges 15*a* and 15*b* are in the shape of a straight line, the cut edges 15*a* and 15*b* can be easily sewn. Thus, the quality can be made uniform, and the yield can be improved by reducing defective products.

Next, the sewing of the divided finger-palm members 12X, 12Y, and 12Z will be further described.

Figure 12:
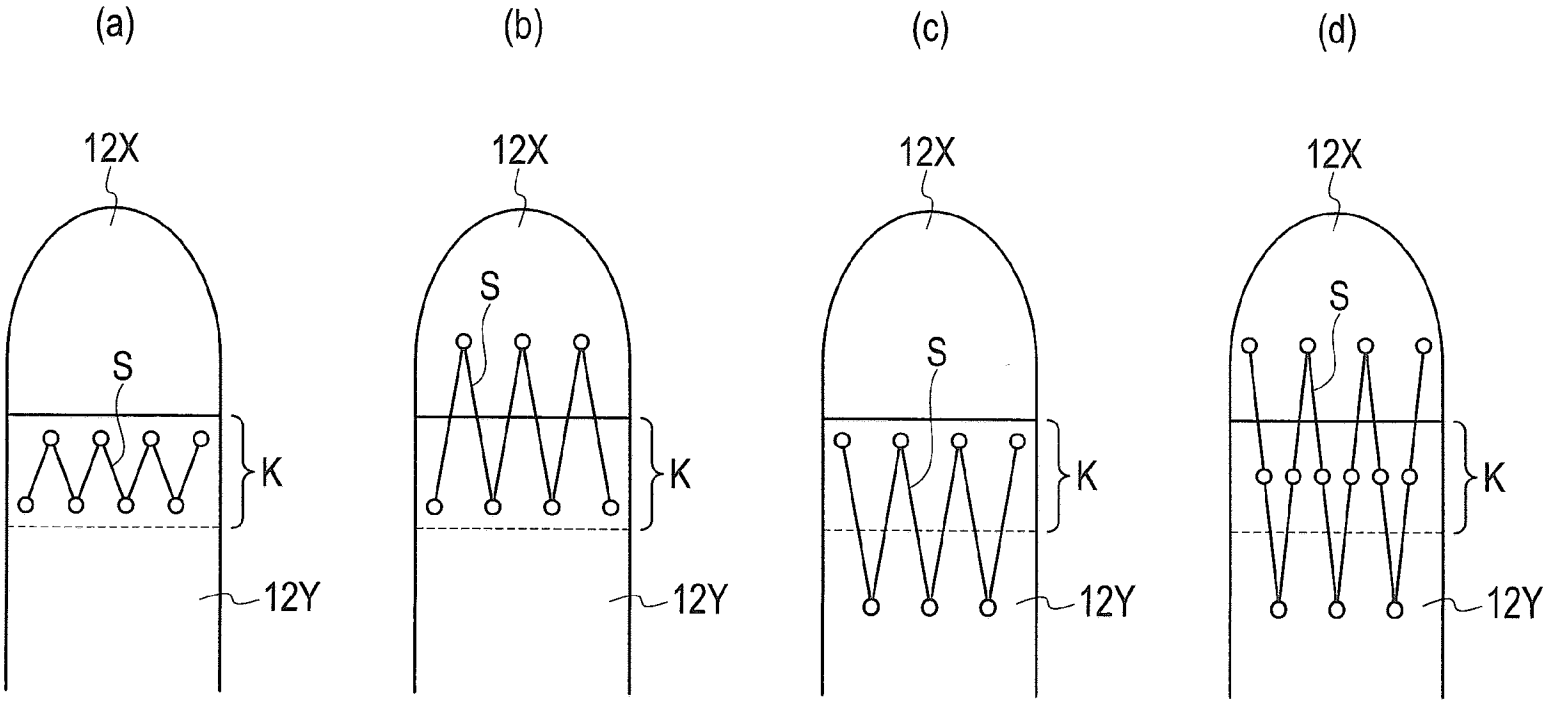
FIG. 12 is an explanatory diagram showing an example of sewing in the sewn glove of the first embodiment of this invention.

When the finger pocket 4 shown in FIG. 3(*a*) is viewed from the finger palm side, a region including an overlapping portion K formed by overlapping the divided finger-palm member 12Y for a middle phalanx on the divided finger-palm member 12X for a distal phalanx is sewn with a thread S in a zigzag manner like a saw blade as shown in FIG. 12.

For example, FIG. 12(*a*) shows the case where only the overlapping portion K present at the fingertip is sewn with a thread S in a zigzag manner like a saw blade, FIG. 12(*b*) shows the case where the divided finger-palm member 12X for a distal phalanx and the overlapping portion K are sewn with a thread S in a zigzag manner like a saw blade, FIG. 12(*c*) shows the case where the overlapping portion K and the divided finger-palm member 12Y for a middle phalanx are sewn with a thread S in a zigzag manner like a saw blade, and FIG. 12(*d*) shows the case where the divided finger-palm member 12X for a distal phalanx, the overlapping portion K, and the divided finger-palm member 12Y for a middle phalanx are sewn with a thread S in a zigzag manner like a saw blade.

Figure 11:
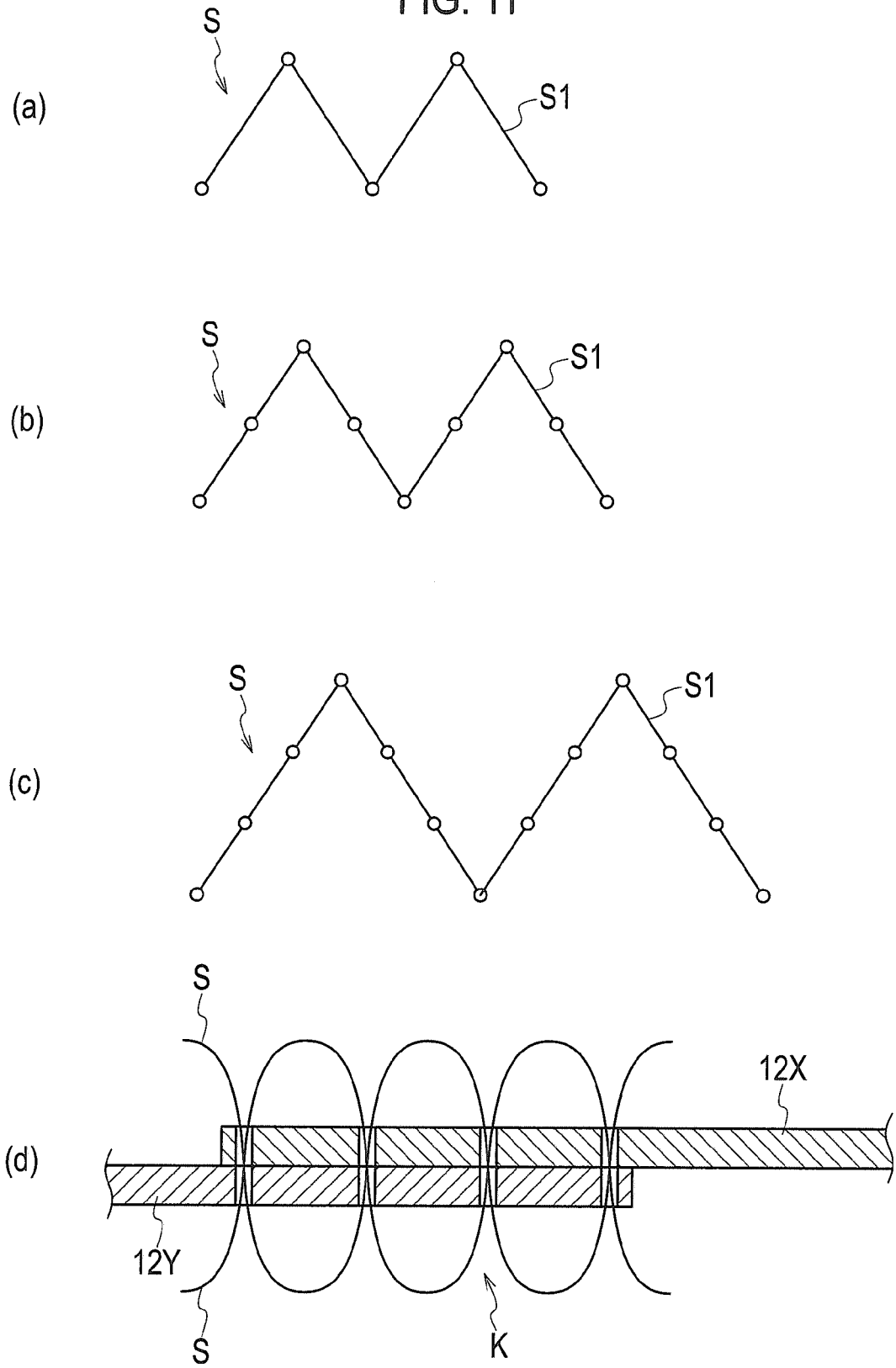
FIG. 11 is an explanatory diagram showing the numbers of seams and threads.

Moreover, the number of seams is not fixed as shown in FIG. 11, but determined by taking factors such as the use of the sewn glove into consideration.

FIG. 11(*a*) shows the case where the number of seams of, for example, an inclined part S1 of a parallel movement mechanism formed by sewing with a thread S is two, FIG. 11(*b*) shows the case where the number of such seams is three, and FIG. 11(*c*) shows the case where the number of such seams is four.

Further, as to the number of threads S, as shown in, for example, FIG. 11(*d*), two threads S instead of only one thread S is preferably used to reinforce a region including the overlapping portion K sewn with threads S.

Figure 13:
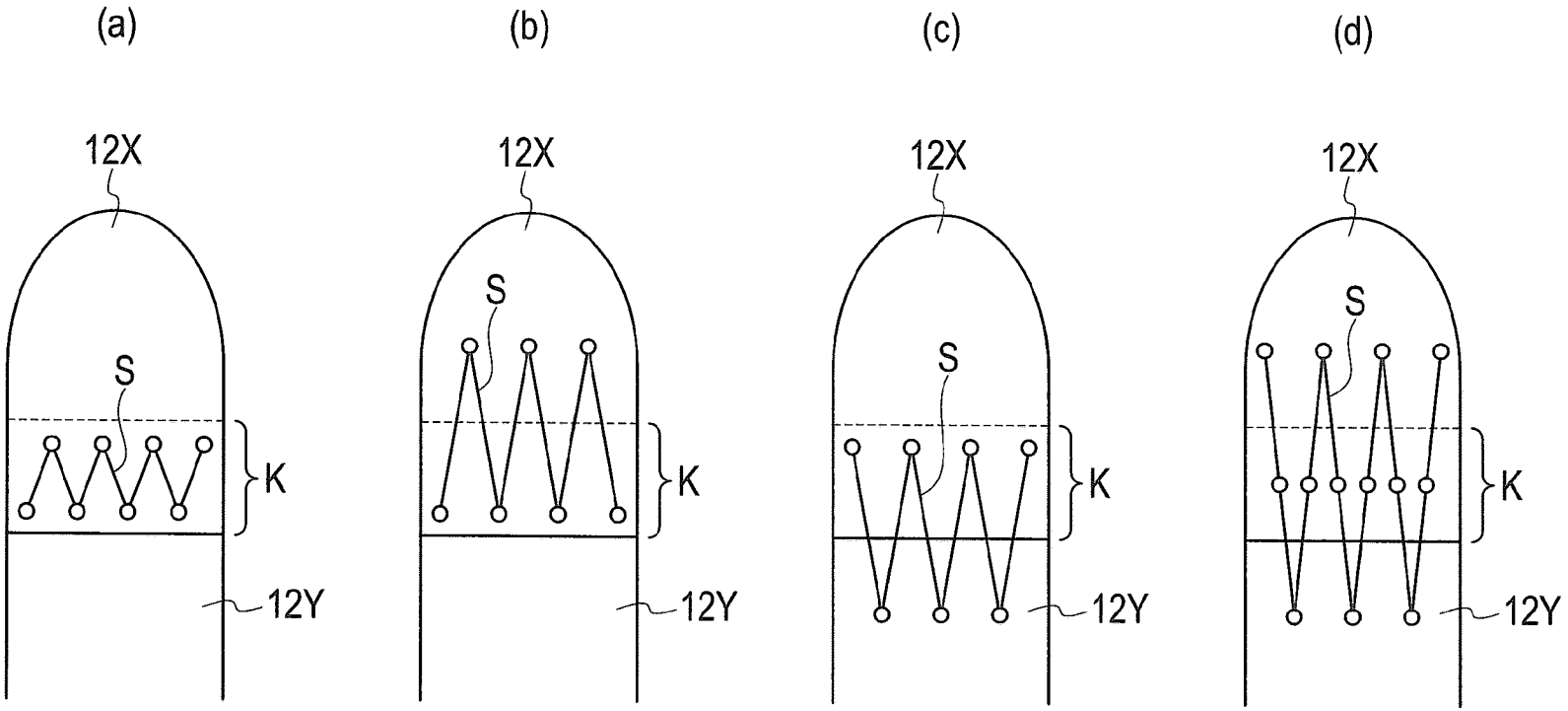
FIG. 13 is an explanatory diagram showing another example of sewing in the sewn glove of the first embodiment of this invention.

FIG. 13 is a view in which the finger pocket 4 shown in FIG. 3(*b*) is viewed from the palm side. A region including the overlapping portion K formed by overlapping the divided finger-palm member 12X for a distal phalanx on the divided finger-palm member 12Y for a middle phalanx is sewn with a thread S in a zigzag manner like a saw blade.

Similarly, for example, FIG. 13(*a*) shows the case where only the overlapping portion K is sewn with a thread S in a zigzag manner like a saw blade, FIG. 13(*b*) shows the case where the divided finger-palm member 12X for a distal phalanx and the overlapping portion K are sewn with a thread S in a zigzag manner like a saw blade, FIG. 13(*c*) shows the case where the overlapping portion K and the divided finger-palm member 12Y for a middle phalanx are sewn with a thread S in a zigzag manner like a saw blade, and FIG. 13(*d*) shows the case where the divided finger-palm member 12X for a distal phalanx, the overlapping portion K, and the divided finger-palm member 12Y for a middle phalanx are sewn with a thread S in a zigzag manner like a saw blade.

In the case of FIG. 13 as well, the number of seams is not fixed (FIG. 11), but determined by taking factors such as the use of the sewn glove of this invention into consideration (FIGS. 11(*a*) to 11(*c*)). Likewise, the number of sewing threads S is preferably, for example, two (FIG. 11(*d*)) so that a region including the overlapping portion K sewn with threads S may be reinforced.

The above-described sewing such as shown in FIG. 12(*b*), 12(*d*), 13(*c*), or 13(*d*) can prevent the curling up of edges of the divided finger-palm members 12X and 12Y which are located on the upper side (surface side).

Figure 14:
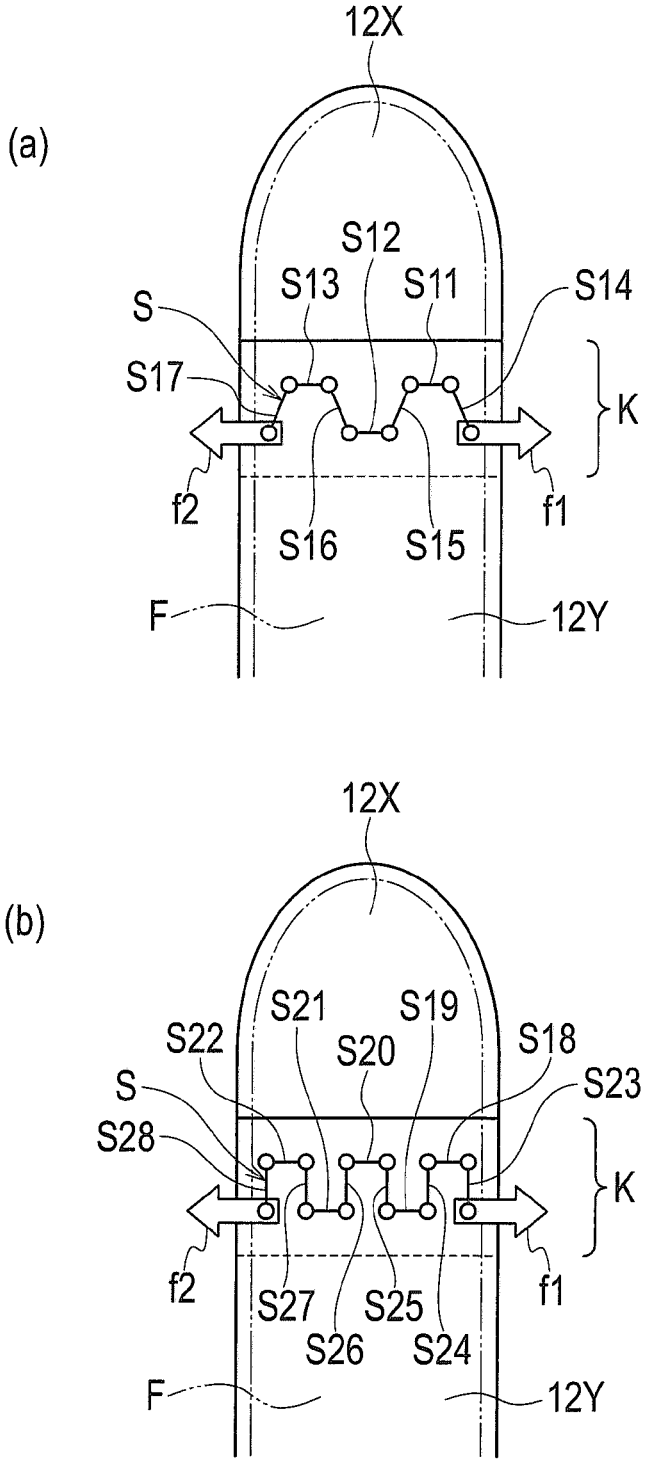
FIG. 14 is an explanatory diagram showing yet another example of sewing in the sewn glove of the first embodiment of this invention.

FIG. 14 is a view showing other examples of sewing.

As the sewing in a zigzag manner shown in FIGS. 12 and 13 is called wave-type sewing, that in FIG. 14(*a*) is called trapezoid-type sewing, and that in FIG. 14(*b*) is called rectangle-type sewing.

If the conventional sewing is called line-type sewing including only straight parts in the horizontal direction (direction along the edges in the shape of a straight line, direction parallel to the interphalangeal joints), the trapezoid-type sewing in FIG. 14(*a*) forms a mixed elastic movement mechanism including straight parts S11 to S13 in the horizontal direction and inclined parts S14 to S17 inclined with respect to the straight parts S11 to S13, while the rectangle-type sewing in FIG. 14(*b*) forms a mixed elastic movement mechanism including straight parts S18 to S22 in the horizontal direction and straight parts S23 to S28 in the vertical direction (direction perpendicular to the direction of the interphalangeal joints) which are perpendicular to the straight parts S18 to S22.

Next, functions of an elastic movement mechanism will be described.

For example, it is assumed that the overlapping portion K is formed by overlapping the divided finger-palm member 12Y for a middle phalanx on the divided finger-palm member 12X for a distal phalanx as shown in FIG. 3(*a*), and that only the overlapping portion K is sewn in a zigzag manner as shown in FIG. 12(*a*).

Figure 15:
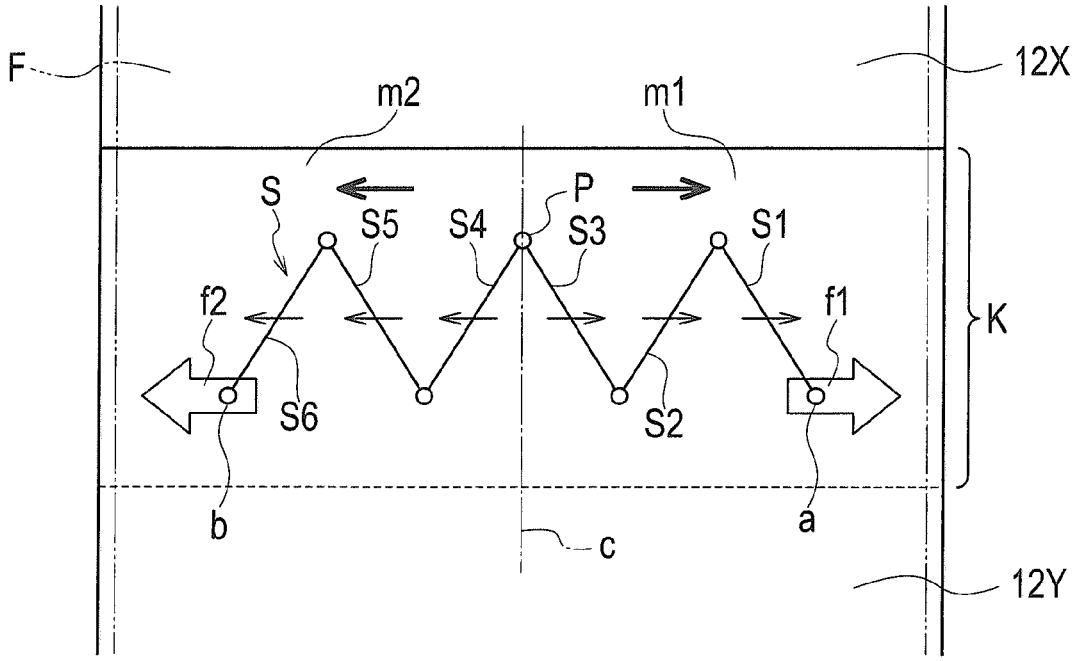
FIG. 15 is an explanatory diagram showing functions of the sewing shown in FIG. 12.

With this assumption, as shown in FIG. 15, the inclined parts S1, S2, and S3 and the inclined parts S4, S5, and S6 of the sewn thread S form an elastic movement mechanism. Moreover, the divided finger-palm members 12X and 12Y are made of general cloth or skin as heretofore and very flexible. Accordingly, the overlapping portion K as a whole is easy to bend.

Further, it is assumed that when such a sewn glove is put on a hand, external forces f1 and f2 in the right and left directions in FIG. 15 act from a finger F of the hand with their application points a and b at seams on two ends of the entire thread S forming the elastic movement mechanism.

With this assumption, the inclined parts S1, S2, and S3 and the inclined parts S4, S5, and S6 of the elastic movement mechanism are displaced to the right and the left of a seam P at the center of the thread S as a center C, respectively.

Thus, in accordance with the movement of the inclined parts S1, S2, and S3 and the inclined parts S4, S5, and S6 of the elastic movement mechanism, a right side part m1 and a left side part m2 of the flexible overlapping portion K can also be displaced in the right and left directions in FIG. 15.

Accordingly, when the sewn glove is put on a hand, the sewn glove stretches and bends to fit the fingers F of the hand. Thus, there is the effect of making the sewn glove easy to conform to the hand and of making the sewn glove comfortable to wear (better to fit).

Another way to sew the divided finger-palm members 12X, 12Y, and 12Z together will be described.

Figure 4:
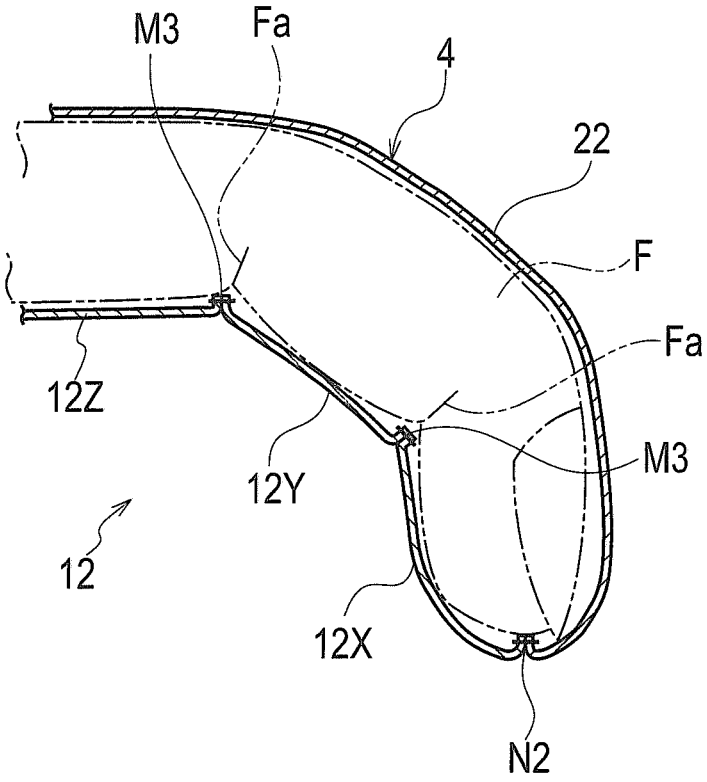
FIG. 4 is a cross-sectional view of the finger pocket of FIG. 1 along the longitudinal direction.

In the glove shown in FIG. 4, for example, the surface side of the divided finger-palm member 12Y is overlapped on the surface side of the divided finger-palm member 12X such that the cut edges 15*a* and 15*b* coincide with each other, and the cut edges 15*a* and 15*b* are sewn together along the cut edges 15*a* and 15*b* (sewn portion M3) (inseam sewing).

Similarly, for the divided finger-palm member 12Y and the divided finger-palm member 12Z, the surface side of the divided finger-palm member 12Z is overlapped on the surface side of the divided finger-palm member 12Y such that the cut edges 15*a* and 15*b* coincide with each other, and the cut edges 15*a* and 15*b* are sewn together along the cut edges 15*a* and 15*b* (sewn portion M3) (inseam sewing).

Note that other parts of the palm member and the hand-back member and the thumb pocket member are sewn normally in a conventional manner. Thus, a glove such as shown in FIG. 4 is sewn.

In the case of FIG. 4 as well, the number of seams is not fixed (FIG. 11), but determined by taking factors such as the use of the sewn glove of this invention into consideration (FIGS. 11(*a*) to 11(*c*)). Likewise, the number of sewing threads S is preferably, for example, two (FIG. 11(*d*)) so that a region including the overlapping portion K sewn with threads S may be reinforced.

Moreover, the way of sewing may be the wave-type sewing in a zigzag manner shown in FIGS. 12 and 13, the trapezoid-type sewing shown in FIG. 14(*a*), or the rectangle-type sewing shown in FIG. 14(*b*).

Figure 17:
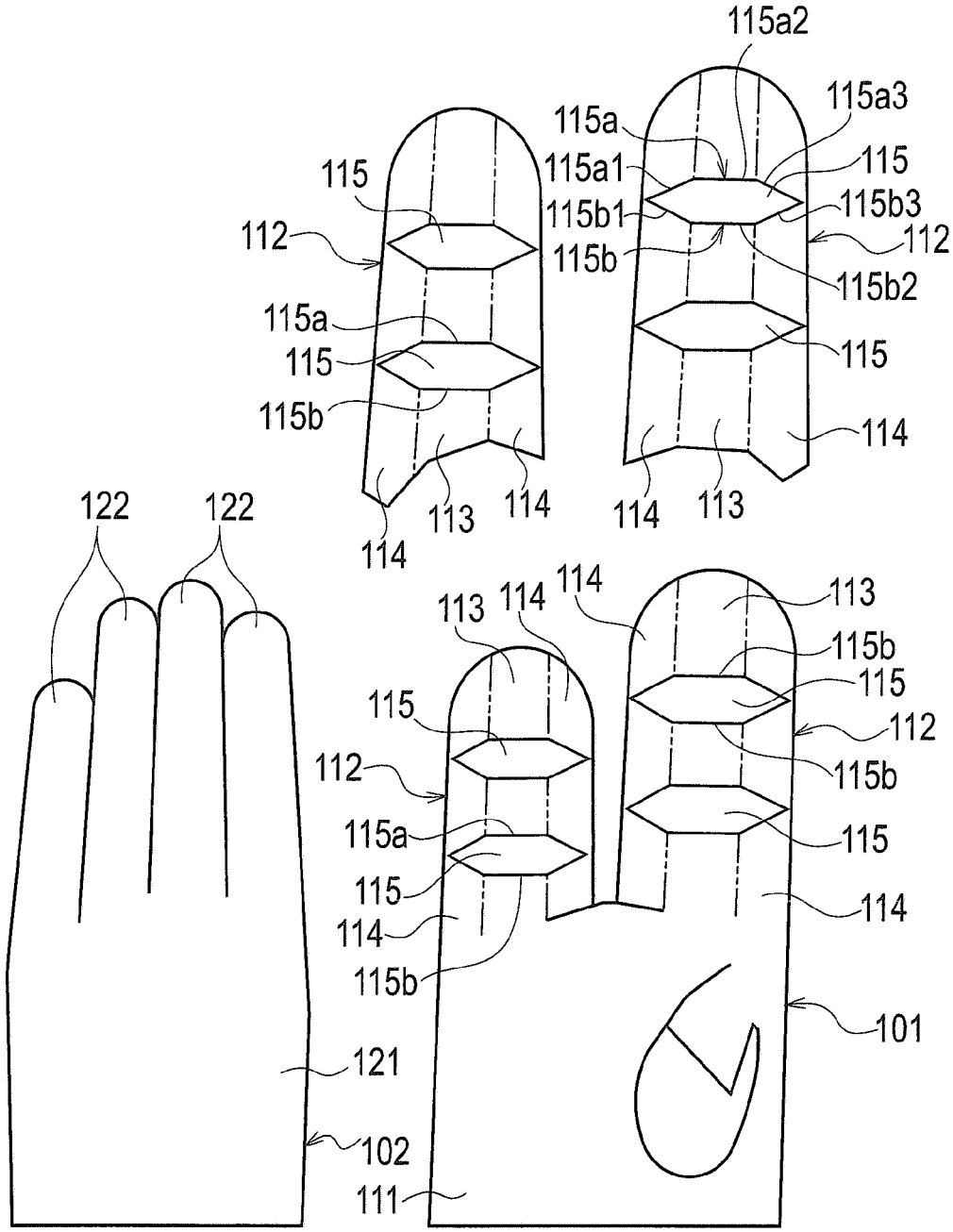
FIG. 17 is a plan view of a palm member and a hand-back member used in the sewn glove of the second embodiment of this invention.

A sewn glove of a second embodiment of this invention is formed approximately similarly to the sewn glove of the first embodiment, except that as shown in FIG. 17, a palm member 112 before sewing is barely continuous at two end portions in the width direction and the palm member 112 for each finger is thereby formed as a single member (e.g., a finger-palm member for an index finger is not divided into a plurality of (three) members but is formed as a single member). The sewn glove of a second embodiment can be modified approximately similarly to the sewn glove of the first embodiment, and has approximately the same effects as the sewn glove of the first embodiment.

Figure 16:
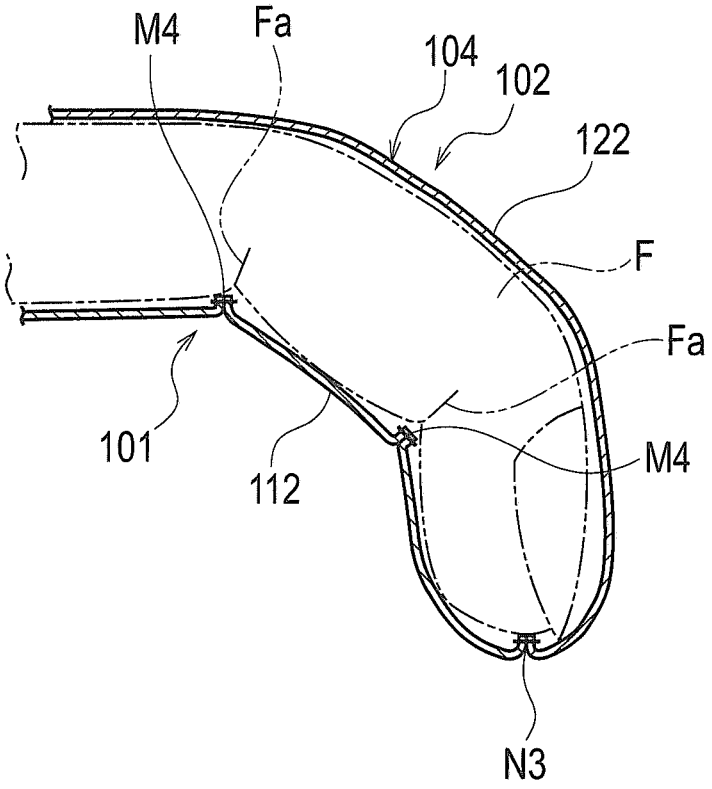
FIG. 16 is a cross-sectional view showing a finger pocket in a sewn glove of a second embodiment of this invention taken in the longitudinal direction.

Moreover, as shown in FIG. 16, the sewn glove of the second embodiment of this invention is sewn using a palm member 101, a hand-back member 102, and an unillustrated thumb pocket member as basic members. In other words, the sewn glove of the second embodiment is sewn using the palm member 101, the hand-back member 102, and the unillustrated thumb pocket member shown in FIG. 17.

As these materials (palm member 101, hand-back member 102, thumb pocket member), leather or synthetic leather is mainly used. Note that the sewn glove of this invention is applied to a comparatively thick glove mainly used for skiing, motorcycling, or the like and used to grasp a grip, but can also be applied to a comparatively thin glove for golf, batting, or the like.

FIG. 17 is a plan view of the palm member 101 and the hand-back member 102 in cut states. The palm member 101 is cut into a so-called gun-cut type (gunn-cut type) , i.e., includes a palm portion 111 having two finger-palm members 112 for an index finger and a little finger cut integrally therewith and further includes two finger-palm members 112 for a middle finger and a ring finger cut separately. Moreover, the hand-back member 102 includes a palm portion 121 and four finger-back members 122 for fingers from a little finger to an index finger cut integrally with the palm portion 121.

Each of the four finger-palm members 112 has a width wide enough to cover the palm surface and right and left sides of a finger. In other words, each of the finger-palm members 112 is cut in such a width that a palm surface covering portion 113 corresponding to the palm surface of a finger has, on the right and left sides thereof, side covering portions 114 and 114 corresponding to the right and left sides of the finger.

In each of the four finger-palm members 112, as shown in FIG. 17, two hexagonal holes 115 and 115 are punched out at positions corresponding to the two interphalangeal joints (the first interphalangeal joint (interphalangeal joint on the finger-tip side) and the second interphalangeal joint (interphalangeal joint on the finger base side)) of a finger, respectively, with a part (approximately 0.5 mm to 1 mm) left uncut on each of the right and left edges of the finger-palm member 112. In each of the holes 115, opposing edges 115*a* and 115*b* are formed to face each other. Here, since each of the holes 115 is formed with a part left uncut on each of the right and left edges of the finger-palm member 112, each of the finger-palm members 112 is continuous as a single member. In other words, each of the holes 115 is provided not only in the palm surface covering portion 113 of the finger-palm member 112 but extending to even the side covering portions 114 and 114 present on the right and left sides of the palm surface covering portion 113.

Each of the holes 115 is designed for bending a finger pocket toward the palm side at positions corresponding to the interphalangeal joints of a finger. In this second embodiment, as shown in FIG. 17, each of the four finger-palm members 112 has two holes 115 formed at positions corresponding to the interphalangeal joints of a finger (first and second interphalangeal joints). Note that for example, in some gloves used for motorcycling, only two finger pockets for a little finger and a ring finger are bent toward the palm side (finger palm side). In such a case, holes 115 may be formed only in finger-palm members for a little-finger pocket and a ring-finger pocket. Moreover, in the case where a thumb pocket is also bent inward, a hole similar to the hole 115 is also formed at a position corresponding to the interphalangeal joint of a thumb in a finger-palm member for a thumb pocket.

In each hole 115 of each finger-palm member 112, the opposing edges 115*a* and 115*b* are placed to face each other. Further, the finger-palm member 112 can be bent toward the finger palm side as shown in FIG. 16 by sewing the opposing edges 115*a* and 115*b* of each hole 115 together along the opposing edges 115*a* and 115*b*. Note that the depth (length in the direction of the length of the finger) of each hole 115 is determined in accordance with the degree to which portions of the finger pocket corresponding to the interphalangeal joints are bent. The deeper the depth of each hole 115 is, the more the interphalangeal joint portion of the finger pocket can be bent.

The above-described opposing edge 115*a* (115*b*) is formed by a straight edge 115*a*2 (115*b*2) of the palm surface covering portion 113, which is parallel to the interphalangeal joints of the finger, and inclined straight edges 115*a*1 and 115*a*3 (115*b*1 and 115*b*3) continuous with the right and left ends of the straight edge 115*a*2 (115*b*2), and extends from the left side covering portion 114 corresponding to the left side of a finger, through the palm surface covering portion 113 corresponding to the palm surface of the finger, to the right side covering portion 114 corresponding to the right side of the finger. The inclined straight edges 115*a*1 and 115*b*1 face each other, the straight edges 115*a*2 and 115*b*2 face each other, and the inclined straight edges 115*a*3 and 115*b*3 face each other. In other words, the opposing edges 115*a* and 115*b* form a hexagon which is formed by six straight lines, and which is formed by joining an isosceles trapezoid (with its base open) on the fingertip side and an isosceles trapezoid (with its base open) on the finger base side together. Further, the depths (distances (lengths) from a straight line connecting the joint between the inclined straight edges 115*a*1 and 115*b*1 and the joint between the inclined straight edges 115*a*3 and 115*b*3 to the straight edges 115*a*2 and 115*b*2) of the opposing edges 115*a* and 115*b* facing each other are the same in the case of inseam sewing.

Note that the inclined straight portions 115*a*1, 115*a*3, 115*b*1, and 115*b*3 and the straight edges 115*a*2 and 115*b*2 forming the opposing edges 115*a* and 115*b* of each of the finger-palm members 112 in FIG. 17 are the same in the opposing edges 115*a* and 115*b* assigned no reference numerals as in the opposing edges 115*a* and 115*b* assigned reference numerals, and therefore the reference numerals are omitted.

This sewn glove of the second embodiment is sewn using the palm member 101 and the hand-back member 102 shown in FIG. 17 and the unillustrated thumb pocket member. In this case, each of finger pockets 104 for fingers from a little finger to an index finger is sewn as shown in FIGS. 24(*a*) to (*c*).

Specifically, FIG. 17 shows a state in which the finger-palm member 112 is expanded, and this finger-palm member 112 includes the finger-palm surface covering portion 113 and further includes, on the right and left sides thereof, the side covering portions 114 and 114 cut integrally with the finger-palm surface covering portion 113. From the expanded state, as shown in FIG. 24(*b*), the finger-palm member 112 is bent in the width direction into a U-shape, and the opposing edges 115*a* and 115*b* of each hole 115 are sewn together along the opposing edges 115*a* and 115*b*. Alternatively, the finger-palm member 112 is bent at a position corresponding to each hole 115 to overlap the opposing edges 115*a* and 115*b*, and the opposing edges 115*a* and 115*b* of each hole 115 are sewn together along the opposing edges 115*a* and 115*b* (inseam sewing).

Sewing the opposing edges 115*a* and 115*b* of each hole 115 together as described above causes the hole 115 to become thinner. Thus, the finger-palm member 112 is bent toward the finger palm side at sewn portions M4 and M4 of the opposing edges 115*a* and 115*b*.

Further, from the state shown in FIG. 24(*b*), as shown in FIG. 24(*c*), the finger-palm member 112 and the finger-back member 122 can be sewn into the shape of the finger pocket 104 by sewing the right and left edges of the finger-palm member 112 and the right and left edges of the finger-back member 122 together, respectively. Note that a sewn portion N3 between each of the right and left edges of the finger-palm member 112 and the corresponding right or left edge of the finger-back member 122 is sewn from, for example, the backsides of the materials (may also be sewn from the surface sides thereof). Moreover, other parts of the palm member 101 and the hand-back member 102 and the thumb pocket member are sewn normally in a conventional manner. Thus, a sewn glove is made. Moreover, processing (hole 115 having the opposing edges 115*a* and 115*b*) similar to the above may also be applied to a position in the thumb pocket which corresponds to an interphalangeal joint to bend the thumb pocket toward the finger palm side.

In this sewn glove of the second embodiment, as shown in FIG. 2, sewn portions are not formed on both sides of the finger-palm member 112. Accordingly, when an item (grip) is grasped with a hand wearing this sewn glove, there is no sewn portion between a finger F and the item, and the bending resistance of the finger pocket 104 becomes small. Thus, each finger pocket 104 is easy to bend, and only a small bending force is needed.

Moreover, a space of a portion of the finger pocket 104 which corresponds to each interphalangeal joint Fa of a finger F is steeply raised by the right and left inclined straight edges 115*a*1, 115*a*3, 115*b*1, and 115*b*3, and a sufficient spatial expanse (length) in a direction perpendicular to the insertion direction of the finger F can be ensured by the straight edges 115*a*2 and 115*b*2. Accordingly, the sewn portion M4 does not touch right and left portions of the interphalangeal joint Fa of the finger F, and the sewn glove can be put on a hand without an uncomfortable feeling. Also, during usage, since the sewn portion M4 lies along the interphalangeal joint Fa of the finger F to reduce the gap between the interphalangeal joint Fa of the finger F and the sewn portion M4 and is buried in a portion of the bent interphalangeal joint Fa of the bent finger F, the finger F can be greatly (deeply) bent without an uncomfortable feeling.

Moreover, each of the opposing edges 115*a* and 115*b* are formed by three straight lines, and each of the opposing edges 115*a* and 115*b* is in the shape of an isosceles trapezoid. Accordingly, edges of the divided finger-palm members 12X, 12Y, and 12Z can be overlapped using the corners of the opposing edges 115*a* and 115*b* as signs. Also, since the sewn portions of the opposing edges 115*a* and 115*b* are in the shape of a straight line, the opposing edges 115*a* and 115*b* can be easily sewn. Thus, the quality can be made uniform, and the yield can be improved by reducing defective products.

Moreover, since sewing the opposing edges 115*a* and 115*b* of the finger-palm member 112 together can be performed in a flat state in which the opposing edges 115*a* and 115*b* are vertically overlapped, the opposing edges 115*a* and 115*b* can be simply and easily sewn together.

In the second embodiment, the sewing method of the opposing edges 115*a* and 115*b* may be any one of line-type sewing, wave-type sewing (zigzag sewing), trapezoid-type sewing, and rectangle-type sewing, as described above.

Moreover, all the finger-palm members 112 may be provided separately from the palm portion 111, and may be divided at positions on the right and left sides of each hole 115 as in the first embodiment.

Figure 18:
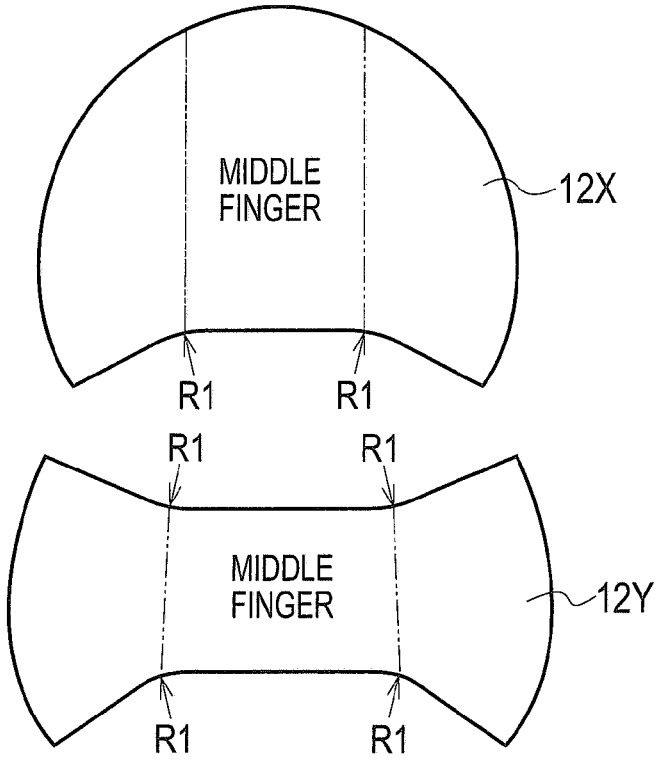
FIG. 18 is an explanatory diagram showing a modified example of the shapes of cut edges in the sewn glove of the first embodiment of this invention.

FIG. 18 is an explanatory diagram showing a modified example of the shape of a cut edge of a divided finger-palm member. This is an example in which arc portions (round portions) R1 are provided in portions where straight lines intersect. In other words, the boundaries between the upper base and legs of the recessed portion in the shape of an isosceles trapezoid are not abruptly bent, but are smoothly bent with the arc portions R1 interposed in between. In the case where the cut edges are made round by providing the arc portions R1 as described above, also, there are functions and effects similar to those in the case of the cut edges which are each formed by three straight lines. Note that in the case where corners of the hexagons are rounded in the embodiment shown in FIGS. 16 and 17, also, there are functions and effects similar to those in the case of the hexagons formed by straight lines.

Figure 19:
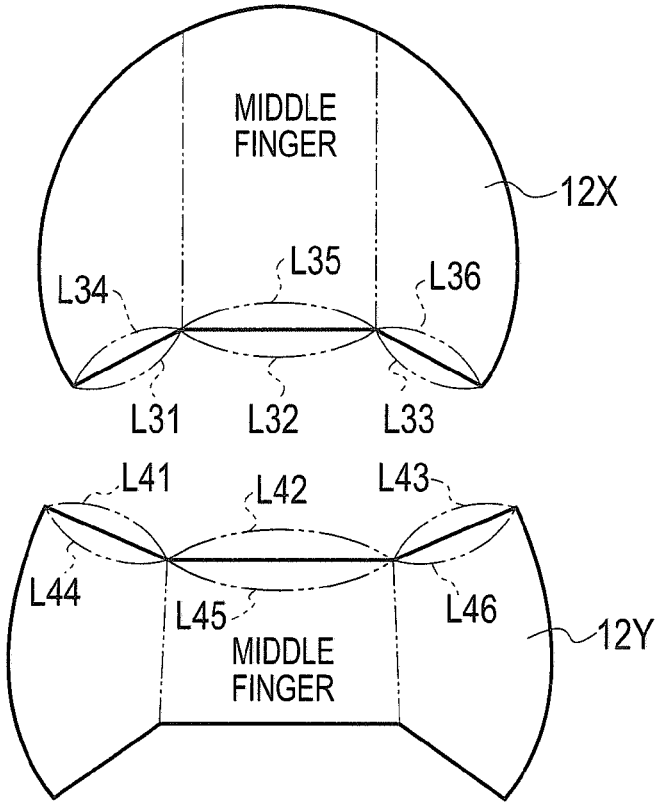
FIG. 19 is an explanatory diagram showing another modified example of the shapes of cut edges in the sewn glove of the first embodiment of this invention.

FIG. 19 is an explanatory diagram showing another modified example of the shape of a cut edge of a divided finger-palm member. This is an example in which the straight portions and/or the inclined straight portions are slightly rounded into round portions L31 to L36 and L41 to L46 as indicated by two-dot chain lines. In this case as well where the straight portions and/or the inclined straight portions are formed in the shape of the arc of an ellipse by rounding the straight portions and/or the inclined straight portions into round portions L31 to L36 and L41 to L46 as described above, there are functions and effects similar to those in the case of the cut edges which are each formed by straight lines. Note that in the case where corners of the hexagons are rounded in the embodiment shown in FIGS. 16 and 17, also, there are functions and effects similar to those in the case of the hexagons formed by straight lines.

Here, the combination of the round portions (arc portions) L31 to L36 and L41 to L46 will be described by taking examples.

In the case where the round portions L34, L32, and L36 indicated by two-dot chain lines are provided in the shape of the recessed portion of the divided finger-palm member 12X, the shape of the recessed portion of the divided finger-palm member 12Y is desirably formed by the round portions L41, L45, and L43 indicated by two-dot chain lines. On the other hand, in the case where the round portions L31, L35, and L33 indicated by two-dot chain lines are provided in the shape of the recessed portion of the divided finger-palm member 12X, the shape of the recessed portion of the divided finger-palm member 12Y is desirably formed by the round portions L44, L42, and L46 indicated by two-dot chain lines. In other words, it is desirable to appropriately modify the shapes of the recessed portions such that recessed portions complement each other (such that recessed portions of the divided finger-palm member 12X and 12Y engage with each other in a state in which round portions have approximately the same curvature radiuses and in which one of the round portions is recessed from the recessed portion side and in which the corresponding one is convex toward the recessed portion side).

Further, in the above description, for example, in the divided finger-palm member 12X, the shapes of the recessed portion in side portions of the divided finger-palm member 12X are convex as shown as the round portions L31 and L33 indicated by two-dot chain lines, and the shape of the recessed portion in an underpart (central portion) of the divided finger-palm member 12X is concave as shown as the round portion L35 indicated by a two dot chain line. However, the present invention is not limited to the above. In the divided finger-palm member 12X, the round portions L31 to L36 indicated by two-dot chain lines may be combined as desired to form a recessed portion, and, in the divided finger-palm member 12Y, the round portions L41 to L46 indicated by two-dot chain lines may be combined as desired to form a recessed portion such that the shape of the recessed portion of the divided finger-palm member 12Y complements the shape of the recessed portion of the divided finger-palm palm member 12X.

In the case where straight portions and/or inclined straight portions are rounded or corners of a hexagon are rounded as described above, the following is preferable: if one of opposing edges is curved concavely, the other opposing edge facing the foregoing opposing edge also has a concavely curved shape; and, if one of opposing edges is curved convexly, the other opposing edge facing the foregoing opposing edge also has a convexly curved shape.

Figure 20:
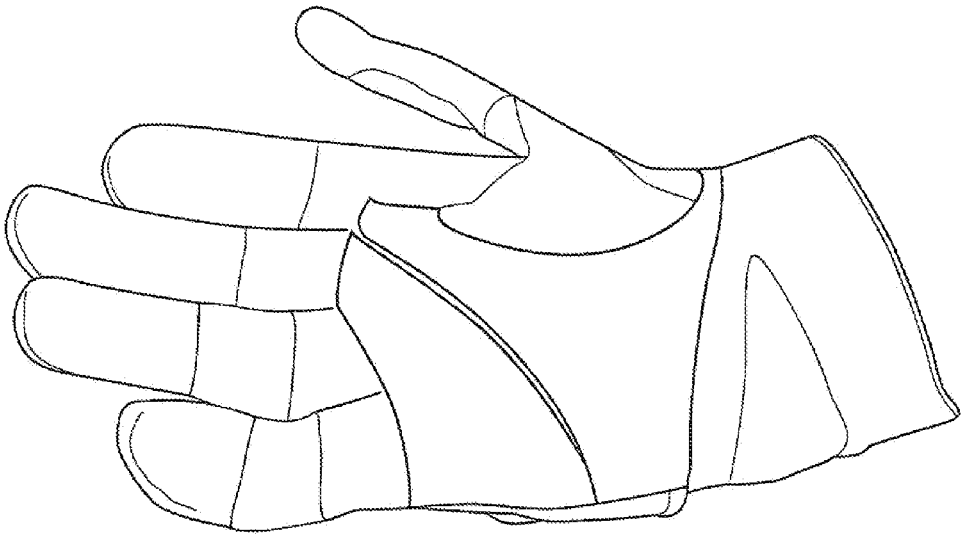
FIG. 20 is a perspective view showing one example in which this invention is applied to a glove for motorcycling.
Figure 21:
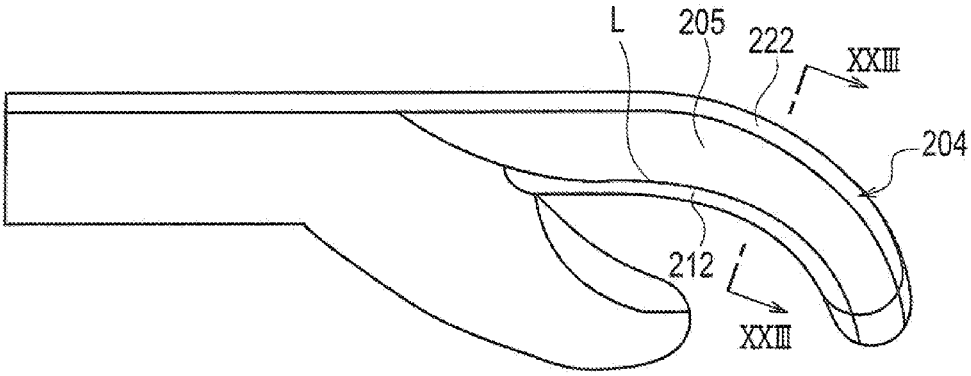
FIG. 21 PRIOR ART
FIG. 21 is a side view of one example of a conventional sewn glove as viewed from a thumb pocket side.
Figure 22:
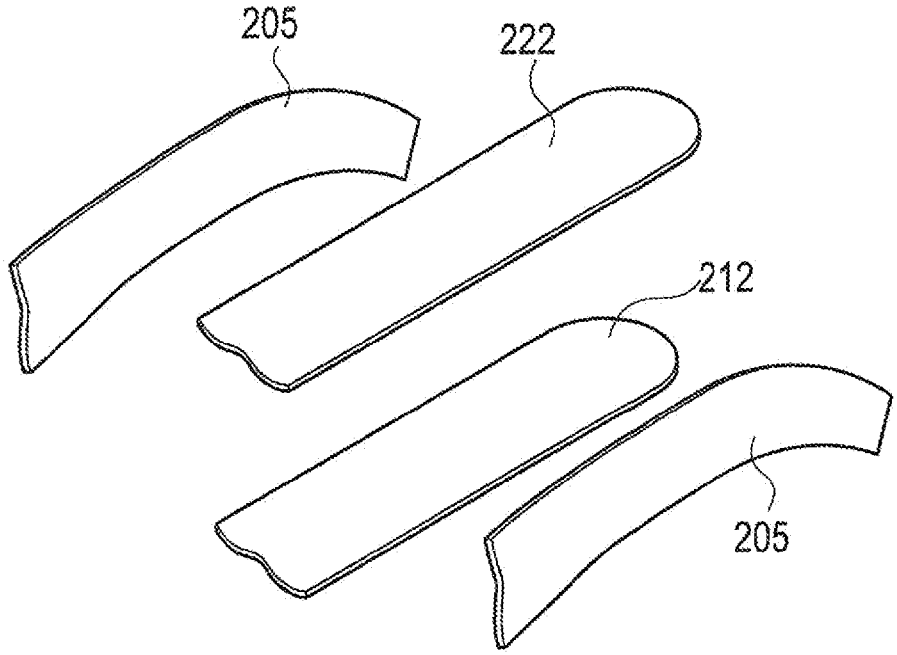
FIG. 22 PRIOR ART
FIG. 22 is an exploded perspective view of finger pocket materials used in a finger pocket portion of the sewn glove shown in FIG. 21.
Figure 23:
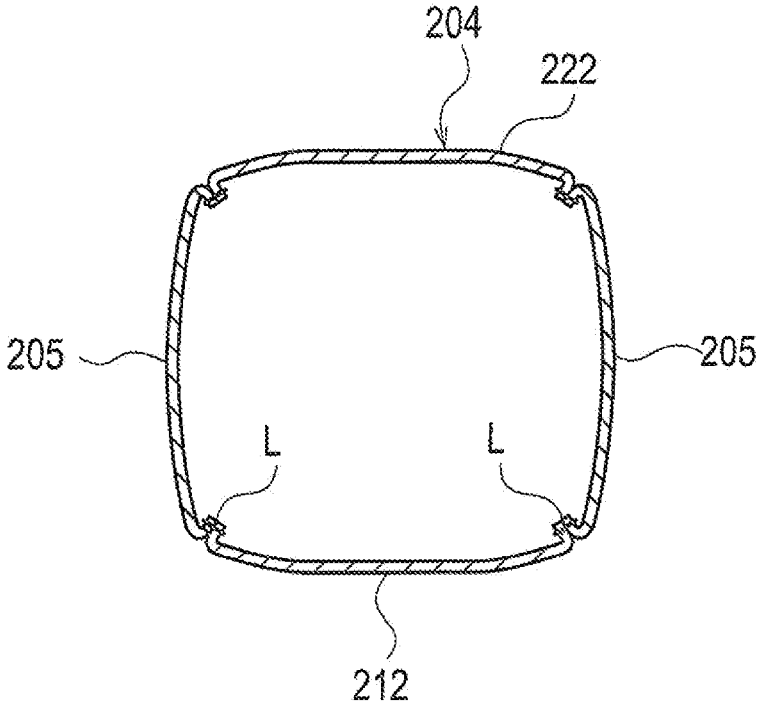
FIG. 23 PRIOR ART
FIG. 23 is an enlarged cross-sectional view taken along line XXIII-XXIII of FIG. 21.

FIG. 20 is a perspective view showing one example in which this invention is applied to a sewn glove for motorcycling. In this example, this invention is applied to first and second interphalangeal joint portions of finger pockets for a ring finger and a little finger that need to be greatly (deeply) bent for purposes such as operating a lever, and this invention is applied to second interphalangeal joint portions of finger pockets for an index finger and a middle finger that do not need to be greatly (deeply) bent for purposes such as operating a lever. As described above, if determining to which portion this invention is applied is made in accordance with the ranges of bending of fingers, a useful sewn glove can be provided.

INDUSTRIAL APPLICABILITY

This invention is applied to a sewn glove with finger pockets, which have been bent toward the palm side in advance so that a ski pole, a motorcycle handgrip, a golf club, a baseball bat, and the like may be easily grasped. In particular, the invention is remarkably useful in the case where a sewn glove is made easy to conform to the fingers of a hand and comfortable to wear by stretching the sewn glove so that the sewn glove may fit the fingers of the hand when the sewn glove is put on the hand.

EXPLANATION OF REFERENCE

1, 101 PALM MEMBER
2, 102 HAND-BACK MEMBER
3 THUMB POCKET MEMBER
4, 104 FINGER POCKET
11, 111 PALM PORTION
12, 112 FINGER-PALM MEMBER
12A to 12D FINGER-PALM MEMBER
12X to 12Z DIVIDED FINGER-PALM MEMBER
13, 113 PALM SURFACE COVERING PORTION
14, 114 SIDE COVERING PORTION
15*a*, 15*b* CUT EDGE
15*a*1, 15*a*3 INCLINED STRAIGHT EDGE
15*a*2, 15*b*2 STRAIGHT EDGE
15*b*1, 15*b*3 INCLINED STRAIGHT EDGE
21, 121 PALM PORTION
22, 122 FINGER-BACK MEMBER
115 HOLE
115*a*, 115*b* OPPOSING EDGE
115*a*1, 115*a*3 INCLINED STRAIGHT EDGE
115*a*2, 115*b*2 STRAIGHT EDGE
115*b*1, 115*b*3 INCLINED STRAIGHT EDGE
F FINGER
Fa INTERPHALANGEAL JOINT

The invention claimed is:

1. A sewn glove comprising:

a finger-back member for covering a back surface of a finger and a finger-palm member with a fingertip side and a finger-base side, the finger-palm member having a palm surface area covering a palm surface of the finger, a first area covering a first surface of the finger between the palm surface and the back surface closer to a thumb, and a second area covering a second surface between the palm surface and the back surface closer to a pinkie, wherein the finger-back member and the finger-palm member form a finger pocket being bent toward a palm surface side, the finger-palm member is divided into a plurality of divided finger-palm members at a position corresponding to each interphalangeal joint of the finger, a divided portion edge of each of the divided finger-palm members is a cut edge having a palm surface cut edge on the palm surface area, a first cut edge on the first area, and a second cut edge on the second area, wherein the cut edge formed into such a recessed shape that inclined straight edges extend continuously from right and left ends of a straight edge of the finger-palm member parallel to the interphalangeal joint of the finger, the divided finger-palm members are sewn together along the cut edges to bend the entire finger pocket including the finger-back member toward the palm surface an average distance between a line of the palm surface cut edge and a line from a first edge furthest from the second area to a second edge furthest from the first area is d, wherein the d is greater than zero, and when more than two divided finger-palm members form the finger pocket, d of one of the divided finger-palm members closest to the fingertip side is shorter than d of one of the divided finger-palm member closest to the finger-base side.

2. The sewn glove according to claim 1, wherein the palm surface cut edge, the first cut edge, and the second cut edge are substantially straight lines.

3. The sewn glove according to claim 2, wherein the line of the palm surface cut edge is substantially parallel to the line from the first edge to the second edge.

4. A sewn glove comprising:

a finger-back member for covering a back surface of a finger and a finger-palm member with a fingertip side and a finger-base side, the finger palm member having a palm surface area covering a palm surface of the finger, a first area covering a first surface of the finger between the palm surface and the back surface closer to a thumb, and a second area covering a second surface between the palm surface and the back surface closer to a pinkie, wherein the finger-back member and the finger-palm member form a finger pocket being bent toward the palm surface side, the finger-palm member has an opening in a shape of a polygon with six corners, at a position corresponding to each interphalangeal joint of the finger, wherein first corner is on the first area, second corner is on the second area, third and fourth corners are located closer to the fingertip side, and fifth and sixth corners are located closer to the finger-base side, an average distance between a line from the first corner to the second corner and a line between the either third and the fourth corners or fifth and sixth corners is d, wherein the d is greater than zero, opposing edges between the first corner and the second corner across the opening which face each other are sewn together along the opposing edges to bend the entire finger pocket including the finger-back member toward the palm side, and when the finger-palm member has more than one openings, d of one of the openings closest to the fingertip side is shorter than d of one of the opening closest to the finger-base side.

5. The sewn glove according to claim 4, wherein the third and the fifth corners are closer to the first corner than to the second corner and fourth and sixth corners are closer to the second corner than to the first corner, a line between the first and the third corners is substantially parallel to a line between the second and the sixth corners, a line between the third and the fourth corners is substantially parallel to a line between the fifth and the sixth corner, and a line between the second and the fourth corners is substantially parallel to a line between the first and the fifth corners.

* * * * *